US010026365B2

(12) United States Patent
Sako et al.

(10) Patent No.: US 10,026,365 B2
(45) Date of Patent: Jul. 17, 2018

(54) DISPLAY DEVICE INCLUDING A CALCULATION ORDER CHANGE SECTION

(71) Applicant: Japan Display Inc., Tokyo (JP)

(72) Inventors: Kazuhiko Sako, Tokyo (JP); Tsutomu Harada, Tokyo (JP); Naoyuki Takasaki, Tokyo (JP)

(73) Assignee: Japan Display Inc., Tokyo (JP)

( * ) Notice: Subject to any disclaimer, the term of this patent is extended or adjusted under 35 U.S.C. 154(b) by 86 days.

(21) Appl. No.: 15/041,569

(22) Filed: Feb. 11, 2016

(65) Prior Publication Data

US 2016/0293087 A1 Oct. 6, 2016

(30) Foreign Application Priority Data

Mar. 30, 2015 (JP) ..... 2015-067898

(51) Int. Cl.
*G09G 3/20* (2006.01)
*G09G 3/34* (2006.01)

(52) U.S. Cl.
CPC ..... *G09G 3/342* (2013.01); *G09G 2320/0626* (2013.01); *G09G 2360/16* (2013.01)

(58) Field of Classification Search
CPC ..... G09G 3/342; G09G 2320/0626; G09G 2360/16
See application file for complete search history.

(56) References Cited

U.S. PATENT DOCUMENTS

2007/0268238 A1* 11/2007 Chang ..... G09G 3/342 345/102
2010/0039368 A1* 2/2010 Kim ..... H05B 41/3921 345/102
2012/0113164 A1* 5/2012 Furukawa ..... G09G 3/3426 345/690
2012/0188217 A1 7/2012 Hasegawa
2015/0109352 A1 4/2015 Takasaki et al.
2015/0356905 A1* 12/2015 Watanabe ..... G09G 3/2003 345/88

FOREIGN PATENT DOCUMENTS

JP 2012-155043 8/2012
JP 2013-029691 2/2013
JP 2015-108818 6/2015

* cited by examiner

*Primary Examiner* — Kwang-Su Yang
(74) *Attorney, Agent, or Firm* — K&L Gates LLP

(57) ABSTRACT

A display device includes an image display panel, a backlight with independently driven light sources for lighting the image display panel, a backlight control section which calculates, on the basis of required luminance for each divided area based on an image signal and luminance distribution information for the backlight, tentative lighting levels of the light sources, selects the light sources in calculation order, calculates estimated luminance of a selected light source on the basis of the calculated tentative lighting levels or the calculated lighting level of an already selected light source and the luminance distribution information, and calculates, if the estimated luminance does not satisfy the required luminance, a lighting level of the selected light source that satisfies the required luminance on the basis of the tentative lighting level thereof and the luminance distribution information, and a calculation order change section which changes the calculation order at determined timing.

4 Claims, 18 Drawing Sheets

DISPLAY DEVICE INCLUDING A CALCULATION ORDER CHANGE SECTION

CROSS REFERENCES TO RELATED APPLICATIONS

The present application claims priority to Japanese Priority Patent Application JP 2015-067898 filed in the Japan Patent Office on Mar. 30, 2015, the entire content of which is hereby incorporated by reference.

BACKGROUND

The embodiments discussed herein are related to a display device and a display device drive method.

In recent years the technique of division drive control in a backlight is known as a technique for reducing the power consumption of a display device. Such division drive control in a backlight is exercised by adjusting a lighting level of each of a plurality of light sources included in the backlight. Accordingly, a light source used at a high luminance value with great frequency deteriorates more rapidly than another light source. As a result, the lifetime of an entire display device shortens. In order to solve this problem, a technique for lengthening the lifetime of a light source is proposed. Furthermore, a technique for remedying a failure of display which occurs at the time of a backlight failure by correcting an image is also proposed.

SUMMARY

There are provided a display device and a display device drive method which reduce the deterioration of a light source.

According to an aspect, there is provided a display device including an image display panel; a backlight in which a plurality of light sources driven independently of one another are arranged and which lights the image display panel; a backlight control section which calculates, on the basis of required luminance for each divided area based on an image signal and luminance distribution information for the backlight stored in advance, a tentative lighting level of each of the plurality of light sources corresponding to the required luminance, which selects the plurality of light sources in order in accordance with determined calculation order, which calculates estimated luminance of a selected light source on the basis of the tentative lighting levels of the plurality of light sources or a calculated lighting level of a light source whose turn comes earlier in the calculation order and the luminance distribution information, and which calculates, when the estimated luminance does not satisfy the required luminance, a lighting level of the selected light source that satisfies the required luminance on the basis of a tentative lighting level of the selected light source and the luminance distribution information; and a calculation order change section which changes the calculation order at determined timing.

The object and advantages of the invention will be realized and attained by means of the elements and combinations particularly pointed out in the claims.

It is to be understood that both the foregoing general description and the following detailed description are exemplary and explanatory and are not restrictive of the invention.

Additional features and advantages are described herein, and will be apparent from the following Detailed Description and the figures.

DETAILED DESCRIPTION

Figure 1:
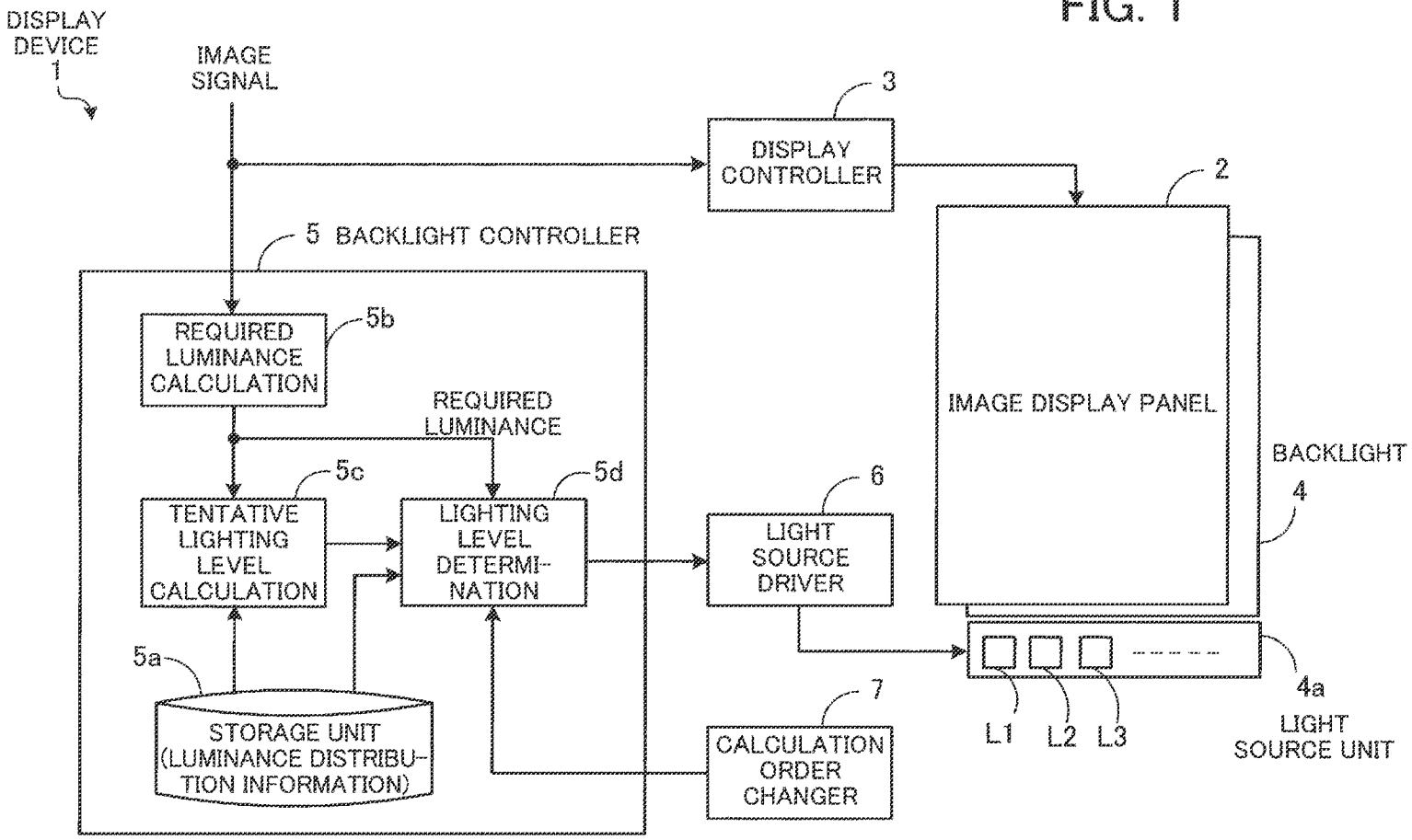
FIG. 1 illustrates an example of the structure of a display device according to a first embodiment.

Embodiments will now be described with reference to the accompanying drawings.

Disclosed embodiments are merely examples. Variations that could readily be made as needed by those skilled in the art within the spirit of the invention fall within the scope of the present invention. Furthermore, while the width, thickness, shape, and the like of each component are illustrated more schematically than in reality in the drawings for the clarity of description, the drawings are provided only to illustrate examples, not to limit the interpretation of the present invention.

In addition, like reference characters refer to like components throughout the drawings, and redundant detailed description will be omitted as needed.

First Embodiment

A display device according to a first embodiment will be described by the use of FIG. 1. FIG. 1 illustrates an example of the structure of a display device according to a first embodiment.

A display device 1 illustrated in FIG. 1 includes an image display panel 2, a display controller 3, a backlight 4, a backlight controller 5, a light source driver 6, and a calculation order changer 7. The image display panel 2 includes pixels arranged in a matrix and displays an image on the display surface. The display controller 3 acquires an image signal, generates a display signal from the image signal, and outputs the display signal to the image display panel 2.

The backlight 4 includes a light source unit 4*a* and lights the image display panel 2 from the rear thereof. A plurality of light sources L1, L2, L3, and so on that are driven independently of one another are arranged in the light source unit 4*a*. In the following description, the term "light sources Ln (n is an arbitrary integer) may be used to collectively refer to the light sources L1, L2, L3, . . . . The backlight 4 emits light emitted from the light source unit 4*a* from an emission surface opposite the display surface of the image display panel 2 to the display surface. For example, white light is emitted from the backlight 4.

The backlight controller 5 stores luminance distribution information in a storage unit 5*a* and exercises division drive control of the backlight 4. The luminance distribution information stored in the storage unit 5*a* is information indicative of the distribution of luminance values of the backlight 4 obtained at the time of lighting each light source Ln at a determined lighting level. For example, the luminance distribution information is generated on the basis of luminance values observed on the display surface of the image display panel 2, and is stored in advance in the storage unit 5*a*.

The backlight controller 5 performs required luminance calculation 5*b*, tentative lighting level calculation 5*c*, and lighting level determination 5*d* in that order to determine a lighting level of a light source Ln. In the required luminance calculation 5*b*, the backlight controller 5 calculates, on the basis of an image signal, required luminance for each divided area obtained by dividing the display surface of the image display panel 2. For example, the required luminance is lowest luminance at which all pixels in a divided area of the image display panel 2 can reproduce color.

In the tentative lighting level calculation 5*c*, the backlight controller 5 calculates a tentative lighting level of each light source Ln of the light source unit 4*a* on the basis of required luminance and the luminance distribution information stored in the storage unit 5*a*. In the tentative lighting level calculation 5*c*, the backlight controller 5 calculates on the basis of the luminance distribution information a tentative lighting level of each light source Ln which satisfies required luminance calculated for each divided area. A tentative lighting level is tentatively calculated before an actual lighting level is determined.

In the lighting level determination 5*d*, the backlight controller 5 selects a light source Ln in order in accordance with calculation order and determines a lighting level of the light source Ln. The light source unit 4*a* is actually driven at these lighting levels. The calculation order is set by the calculation order changer 7. In the case of FIG. 1, for example, the light sources L1, L2, L3, and so on are arranged in one direction. The calculation order changer 7 designates a forward direction or a reverse direction. If the calculation order changer 7 designates the forward direction, then the light source Ln is selected from the L1 side. In the lighting level determination 5*d*, the backlight controller 5 calculates estimated luminance for a divided area corresponding to the selected light source Ln. The backlight controller 5 calculates the estimated luminance on the basis of tentative lighting levels of the plurality of light sources Ln or a calculated lighting level of a light source whose turn comes before the selected light source Ln in calculation order and the luminance distribution information. In the lighting level determination 5*d*, the backlight controller 5 compares the estimated luminance for the divided area corresponding to the selected light source Ln with required luminance. If the estimated luminance for the divided area corresponding to the selected light source Ln does not satisfy the required luminance, then the backlight controller 5 calculates a lighting level of the selected light source Ln which satisfies the required luminance. In the lighting level determination 5*d*, the backlight controller 5 repeats the same process in accordance with the calculation order to determine lighting levels of all the light sources in the light source unit 4*a*.

The light source driver 6 controls a light source Ln on the basis of a lighting level determined by the backlight controller 5.

The calculation order changer 7 changes at determined timing calculation order in which the backlight controller 5 performs calculations. For example, if the forward direction is set as the calculation order, that is to say, selection is begun at the light source L1 illustrated in FIG. 1, then the calculation order changer 7 changes the forward direction at determined timing to the reverse direction. Furthermore, the calculation order changer 7 changes the calculation order at the next determined timing from the reverse direction to the forward direction. This operation is performed so that selection will not be made only in one direction. For example, the determined timing may be the elapse of a constant time or the occurrence of an external event such as when power is applied to the display device 1.

With the display device 1 having the above structure, the backlight controller 5 exercises division drive control of the backlight 4 according to required luminance required for display on the image display panel 2. The backlight controller 5 performs the required luminance calculation 5*b*, the tentative lighting level calculation 5*c*, and the lighting level determination 5*d* for each divided area to control the luminance of the backlight 4. In the required luminance calculation 5*b*, the backlight controller 5 calculates on the basis of an image signal required luminance required for display for each divided area. In the tentative lighting level calculation 5*c*, the backlight controller 5 calculates, on the basis of the required luminance and luminance distribution information, a tentative lighting level of a light source Ln which satisfies the required luminance for each divided area. In the lighting level determination 5*d*, the backlight controller 5 selects in order a light source Ln from the light source unit 4*a* in accordance with calculation order. If estimated luminance calculated for each divided area does not satisfy the required luminance, then the backlight controller 5 calculates a lighting level of the selected light source Ln which satisfies the required luminance.

When a lighting level of each light source Ln included in the light source unit 4*a* is determined in order, a lighting level of a light source Ln whose turn comes earlier in calculation order tends to become higher than a lighting level of a light source Ln whose turn comes later in the calculation order. For example, it is assumed that when a lighting level is determined in the calculation order of the light sources L1, L2, and L3, luminance for areas corresponding to the light sources L1 and L2 is insufficient. At the time when a lighting level of the light source L1 is calculated in accordance with the calculation order, both of the light sources L1 and L2 are in a state in which their luminance is insufficient. As a result, estimated luminance for the area corresponding to the light source L1 is low. Accordingly, a lighting level of the light source L1 for satisfying required luminance is high. A high lighting level of the light source L1 is calculated in this way. As a result, with the light source L2 whose turn comes next in the calculation order, estimated luminance for the area corresponding to the light source L2 tends to become higher. Accordingly, a lighting level of the light source L2 is smaller than the lighting level of the light source L1. In this case, an increase in the lighting level of the light source L1 precedes an increase in the lighting level of the light source L2 and there is a tendency for an increase in the lighting level of the light source L1 to become higher than an increase in the lighting level of the light source L2. The display device 1 changes the calculation order at determined timing. This reduces non-uniformity of lighting levels of the light sources Ln which make up for a deficiency in luminance. As a result, the degree to which each light source Ln is degraded is equalized. The principal object is to reduce non-uniformity of degradation of the light sources Ln. Therefore, it is desirable to make the determined timing longer than a processing cycle of the backlight controller 5.

Second Embodiment

Figure 2:
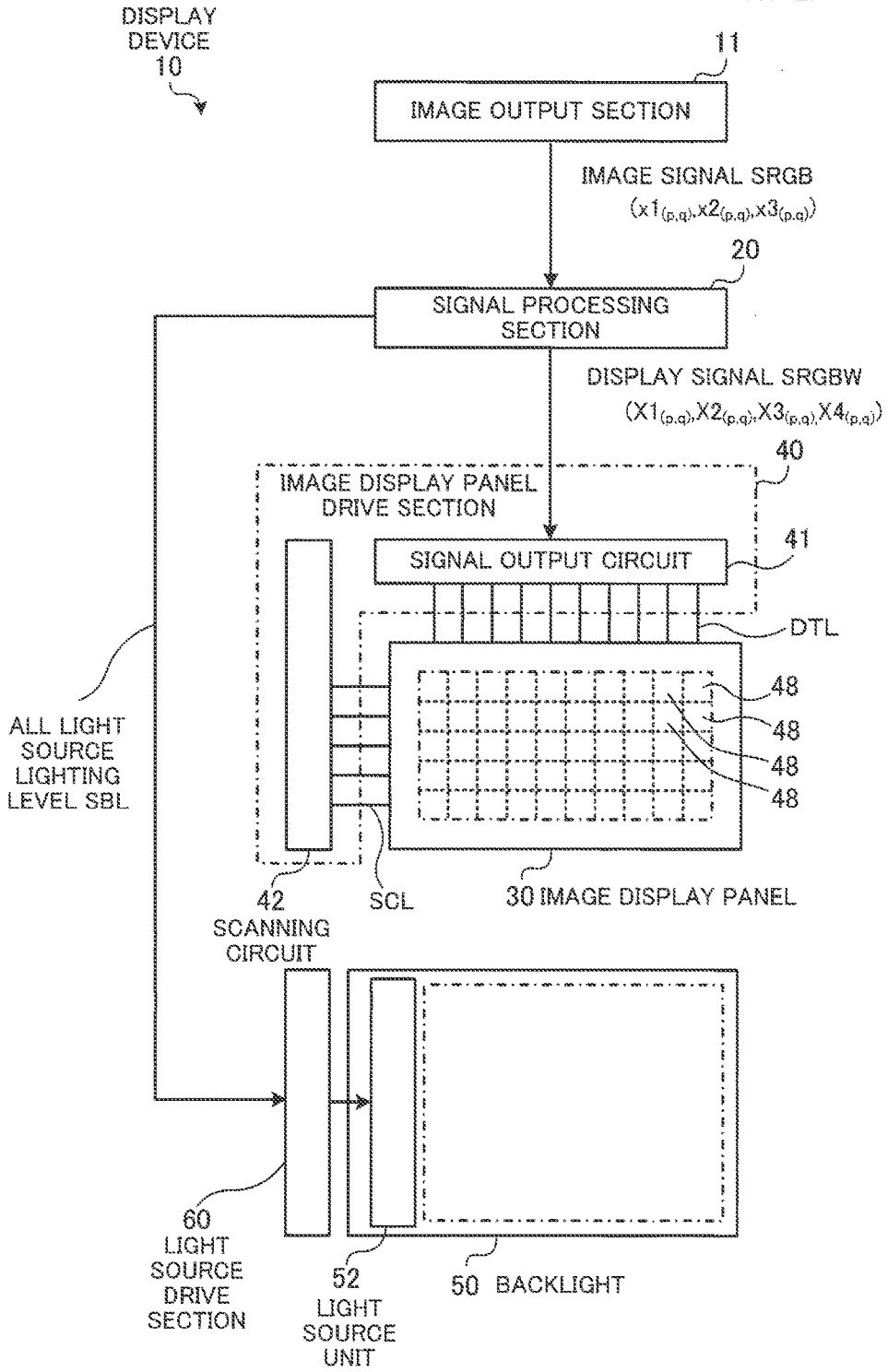
FIG. 2 illustrates an example of the structure of a display device according to a second embodiment.

A display device according to a second embodiment will now be described. First the structure of a display device will be described, and then a process performed by the display device will be described. FIG. 2 illustrates an example of the structure of a display device according to a second embodiment.

A display device 10 illustrated in FIG. 2 includes an image output section 11, a signal processing section 20, an image display panel 30, an image display panel drive section 40, a backlight 50, and a light source drive section 60. The display device 10 is an example of the display device 1 illustrated in FIG. 1.

The image output section 11 outputs an image signal SRGB to the signal processing section 20. The image signal SRGB includes an image signal value $x1_{(p,q)}$ for a first primary color, an image signal value $x2_{(p,q)}$ for a second primary color, and an image signal value $x3_{(p,q)}$ for a third primary color. In the second embodiment, for example, it is assumed that the first primary color is red, that the second primary color is green, and that the third primary color is blue. "p" is an integer and satisfies $$1 \le p \le P$$

where P is the number of pixels 48 in the horizontal direction. "q" is an integer and satisfies $$1 \le q \le Q$$

where Q is the number of the pixels 48 in the vertical direction.

The signal processing section 20 is connected to the image display panel drive section 40 which drives the image display panel 30 and is connected to the light source drive section 60 which drives the backlight 50. The signal processing section 20 converts the image signal SRGB to a display signal SRGBW and outputs the display signal SRGBW to the image display panel drive section 40. In addition to a display signal value $X1_{(p,q)}$ corresponding to a first subpixel, a display signal value $X2_{(p,q)}$ corresponding to a second subpixel, and a display signal value $X3_{(p,q)}$ corresponding to a third subpixel, the display signal SRGBW includes a display signal value $X4_{(p,q)}$ corresponding to a fourth subpixel. Furthermore, the signal processing section 20 generates an all light source lighting level SBL, which is a control signal for division-driving the backlight 50, on the basis of the image signal SRGB and outputs the all light source lighting level SBL to the light source drive section 60. The signal processing section 20 is an example of the display controller 3 and the backlight controller 5 illustrated in FIG. 1.

The image display panel 30 includes (P×Q) pixels 48 arranged in a two-dimensional matrix. Each pixel 48 includes the first subpixel, the second subpixel, the third subpixel, and the fourth subpixel. There is no special limitation on the arrangement of these subpixels. Furthermore, for example, the first subpixel displays red, the second subpixel displays green, the third subpixel displays blue, and the fourth subpixel displays white. However, colors which the first subpixel, the second subpixel, the third subpixel, and the fourth subpixel display are not limited to them. The image display panel drive section 40 includes a signal output circuit 41 and a scanning circuit 42 and exercises display control of the image display panel 30 on the basis of the display signal SRGBW.

The signal output circuit 41 and the scanning circuit 42 are electrically connected to the first subpixel, the second subpixel, the third subpixel, and the fourth subpixel of the image display panel 30 via signal lines DTL and scanning lines SCL respectively. Each subpixel is connected not only to a signal line DTL but also to a scanning line SCL via a switching element (such as a thin film transistor (TFT)). The image display panel drive section 40 selects subpixels by the scanning circuit 42 and outputs display signals in order from the signal output circuit 41. By doing so, the image display panel drive section 40 controls the operation (light transmittance) of the subpixels.

The backlight 50 is arranged on the back side of the image display panel 30 and emits light to the image display panel 30. By doing so, the backlight 50 lights the image display panel 30. Furthermore, the backlight 50 includes a light source unit 52 along a side of its display surface. The light source unit 52 includes a plurality of light sources which operate independently of one another. As a result, division drive control of the backlight 50 is exercised. The light source drive section 60 exercises division drive control of the backlight 50 on the basis of the all light source lighting level SBL outputted from the signal processing section 20. The all light source lighting level SBL is information obtained by combining lighting levels calculated for the plurality of light sources included in the light source unit 52.

Figure 3:
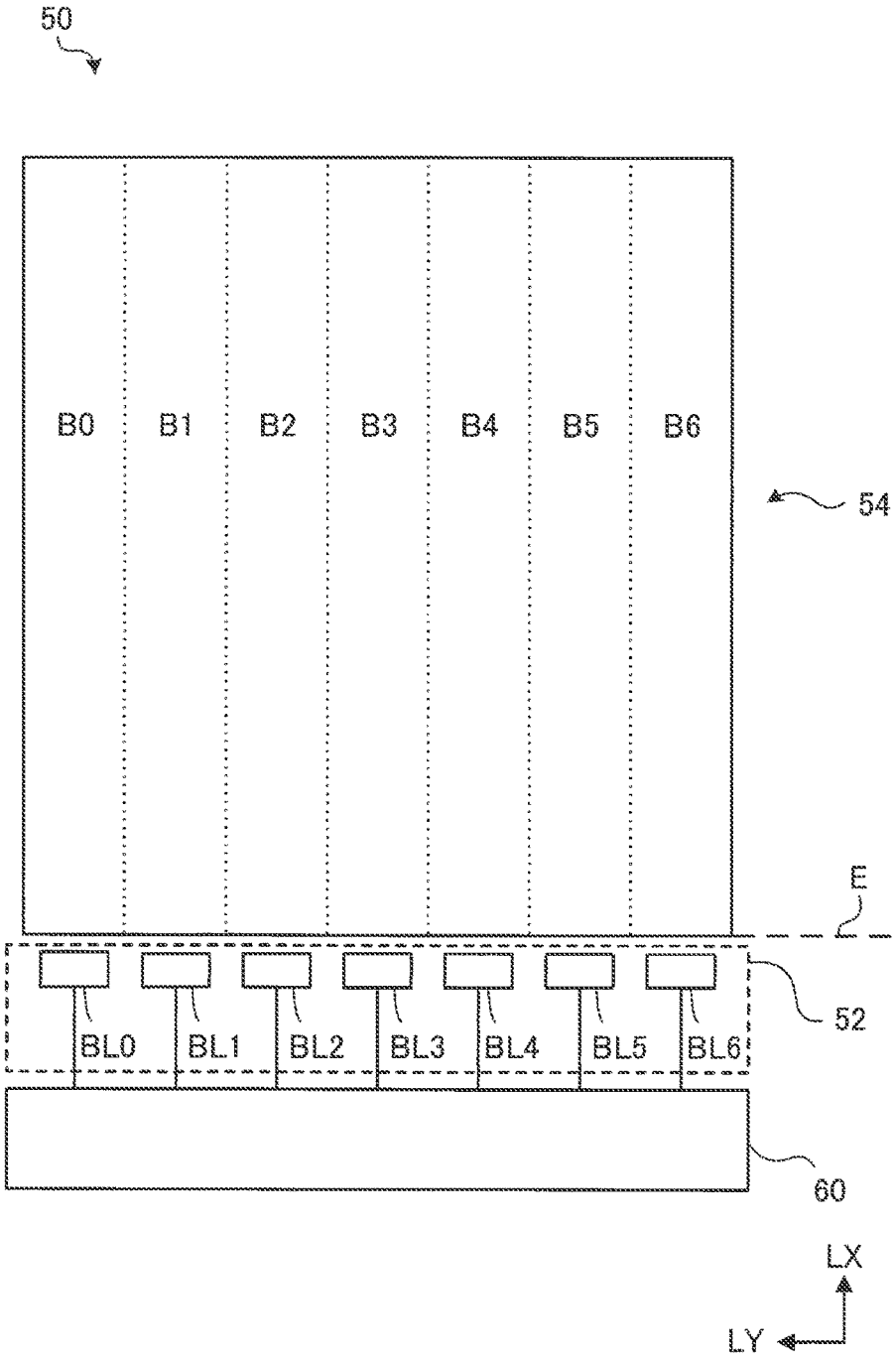
FIG. 3 illustrates an example of the structure of a backlight in the second embodiment.

The backlight 50 will now be described by the use of FIG. 3. FIG. 3 illustrates an example of the structure of the backlight in the second embodiment.

The backlight 50 illustrated in FIG. 3 includes a light guide plate 54 and the light source unit 52 in which light sources BL0, BL1, BL2, BL3, BL4, BL5, and BL6 are arranged opposite an incident surface E that is at least one side of the light guide plate 54. The light sources BL0, BL1, BL2, BL3, BL4, BL5, and BL6 are light-emitting diodes (LEDs) which emit light of the same color (white, for example), and their current values or duty ratios are controlled independently of one another. The light sources BLn are brought into a line along the one side of the light guide plate 54. It is assumed that the direction in which the light sources BLn are arranged is a light source arrangement direction LY. Light emitted from the light sources BLn is inputted from the incident surface E to the light guide plate 54 in an incident direction LX perpendicular to the light source arrangement direction LY. Furthermore, light which enters the light guide plate 54 is emitted from a surface opposite the image display panel 30.

With the display device 10 it is assumed that areas of the light guide plate 54 corresponding to the light sources BL0, BL1, BL2, BL3, BL4, BL5, and BL6 obtained by dividing the light guide plate 54 in the incident direction LX are blocks B0, B1, B2, B3, B4, B5, and B6 respectively and that each block is considered as a processing unit for calculating a lighting level of each light source BLn. How to divide a plane of the light guide plate 54 opposite a display surface of the image display panel 30 may be determined properly.

Lights emitted from the light sources BLn, through the light guide plate 54, to a back of the image display panel 30 have different luminance distributions according to the positions at which the light sources BLn are arranged. These luminance distributions which differ among the light sources BLn are measured in advance as light-source-specific luminance distribution information.

The light source drive section 60 adjusts the values of current supplied to the light sources BLn or duty ratios on the basis of an all light source lighting level SBL outputted from the signal processing section 20. By doing so, the light source drive section 60 controls the amounts of the lights of the light sources BLn and controls the luminance (intensity of the light) of the backlight 50.

Figure 4:
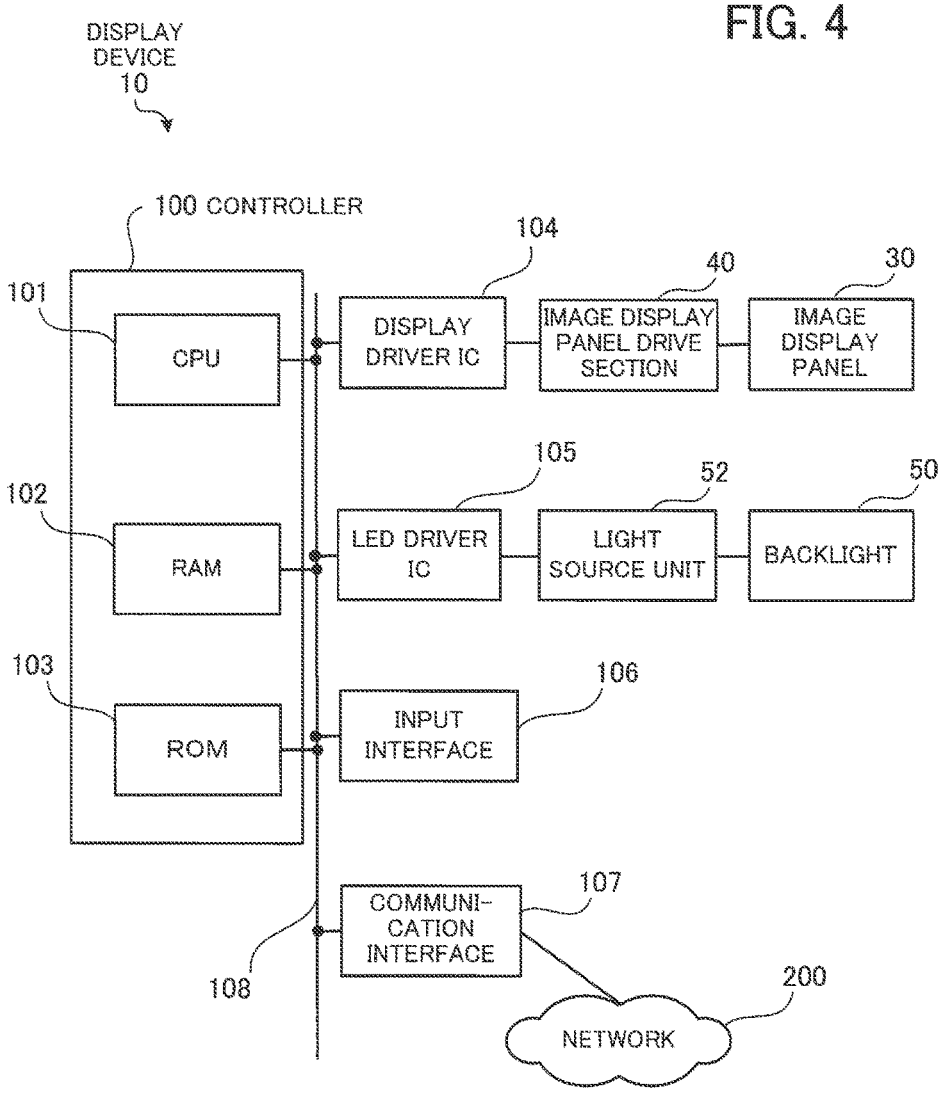
FIG. 4 illustrates an example of the hardware configuration of the display device according to the second embodiment.

The hardware configuration of the display device 10 will now be described. FIG. 4 illustrates an example of the hardware configuration of the display device according to the second embodiment.

The whole of the display device 10 is controlled by a controller 100. The controller 100 includes a central processing unit (CPU) 101. A random access memory (RAM) 102, a read only memory (ROM) 103, and a plurality of peripheral units are connected to the CPU 101 via a bus 108.

The CPU 101 is a processor which realizes the processing functions of the controller 100.

The RAM 102 is used as main storage of the controller 100. The RAM 102 temporarily stores at least a part of an operating system (OS) program or an application program executed by the CPU 101. In addition, the RAM 102 stores various pieces of data which the CPU 101 needs to perform a process.

The ROM 103 is a read only semiconductor memory and stores an OS program, an application program, and fixed data which is not rewritten. Furthermore, a semiconductor memory, such as a flash memory, may be used as auxiliary storage in place of the ROM 103 or in addition to the ROM 103.

The plurality of peripheral units connected to the bus 108 are a display driver integrated circuit (IC) 104, an LED driver IC 105, an input interface 106, and a communication interface 107.

The image display panel drive section 40 is connected to the display driver IC 104. The display driver IC 104 outputs a display signal SRGBW to the image display panel drive section 40 to display an image on the image display panel 30.

The light source unit 52 is connected to the LED driver IC 105. The LED driver IC 105 drives the light source unit 52 by an all light source lighting level SBL and controls the luminance of the backlight 50. The LED driver IC 105 is an example of the light source drive section 60.

An input device used for inputting a user's instructions is connected to the input interface 106. An input device, such as a keyboard, a mouse used as a pointing device, or a touch panel, is connected. The input interface 106 transmits to the CPU 101 a signal transmitted from the input device.

The communication interface 107 is connected to a network 200. The communication interface 107 transmits data to or receives data from another computer or a communication apparatus via the network 200.

By adopting the above hardware configuration, the processing functions in the second embodiment are realized. The above hardware configuration is an example and is changed according to circumstances.

The processing functions of the signal processing section 20 illustrated in FIG. 2 are realized by the controller 100 or the display driver IC 104.

If the processing functions of the signal processing section 20 are realized by the display driver IC 104, then an image signal SRGB is inputted to the display driver IC 104 via the CPU 101. The display driver IC 104 converts the image signal SRGB to a display signal SRGBW and controls the image display panel 30. In addition, the display driver IC 104 generates an all light source lighting level SBL and outputs it to the LED driver IC 105 via the bus 108.

If the processing functions of the signal processing section 20 are realized by the CPU 101, then a display signal SRGBW is inputted from the CPU 101 to the display driver IC 104. An all light source lighting level SBL is also generated by the CPU 101 and is transmitted to the LED driver IC 105 via the bus 108.

Figure 5:
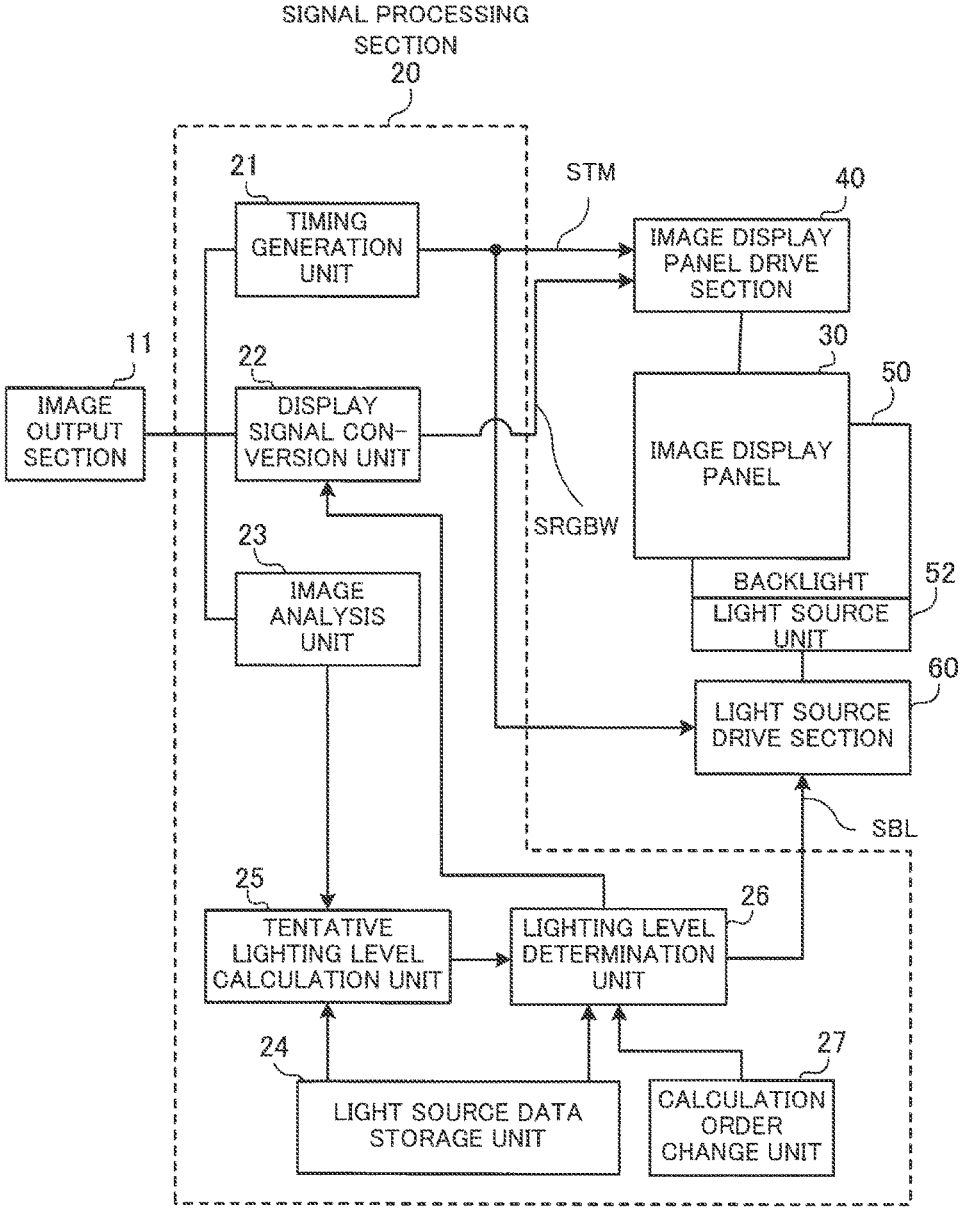
FIG. 5 is a functional block diagram of a signal processing section in the second embodiment.

The structure of the functions of the signal processing section 20 will now be described. FIG. 5 is a functional block diagram of the signal processing section in the second embodiment.

The signal processing section 20 includes a timing generation unit 21, a display signal conversion unit 22, an image analysis unit 23, a light source data storage unit 24, a tentative lighting level calculation unit 25, a lighting level determination unit 26, and a calculation order change unit 27. An image signal SRGB is inputted from the image output section 11 to the signal processing section 20. The image signal SRGB includes color information for an image displayed at the position of each pixel 48.

The timing generation unit 21 generates a synchronization signal STM every image display frame for synchronizing the operation timing of the image display panel drive section 40 with that of the light source drive section 60. The timing generation unit 21 outputs the generated synchronization signal STM to the image display panel drive section 40 and the light source drive section 60.

The display signal conversion unit 22 calculates, on the basis of the color information included in the image signal SRGB, a conversion coefficient for converting the image signal SRGB to a display signal SRGBW, and uses the conversion coefficient for converting the image signal SRGB to a display signal SRGBW. The conversion coefficient is used for converting the image signal SRGB including the color information for the three primary colors to a display signal SRGBW for the image display panel 30 including the first subpixel, the second subpixel, the third subpixel, and the fourth subpixel. The details of the conversion coefficient will be described later. In addition, the display signal conversion unit 22 corrects the display signal SRGBW on the basis of luminance information for the backlight 50 inputted from the lighting level determination unit 26.

On the basis of the image signal SRGB, the image analysis unit 23 calculates required luminance of the backlight 50 required for each divided area obtained by dividing the display surface of the image display panel 30. In the following description each divided area will be referred to as a block. Any way may be adopted to divide the display surface for forming blocks. With division drive control of the backlight 50 the luminance of the backlight 50 is adjusted according to an image to be displayed. Accordingly, the image analysis unit 23 analyzes the image signal SRGB corresponding to a block and calculates required luminance required for displaying an image. For example, a conversion coefficient for converting the image signal SRGB to a display signal SRGBW is calculated on the basis of color information for the first primary color, the second primary color, and the third primary color included in the image signal SRGB, and required luminance is calculated on the basis of the conversion coefficient.

The light source data storage unit 24 stores various pieces of information referred to in the signal processing section 20. A luminance value of a representative pixel which represents pixels included in a determined area obtained by dividing the display surface is recorded for each light source in a tabular form in light-source-specific luminance distribution information included in the various pieces of information. The determined area obtained by dividing the display surface may not be the same as the block for which a conversion coefficient is calculated. In the following description such light-source-specific luminance distribution information in a tabular form will be referred to as a light-source-specific lookup table (LUT). A light-source-specific LUT is information specific to the display device 10. Therefore, it is created in advance and is stored in the light source data storage unit 24. A light-source-specific LUT is prepared for each of the light sources BL0 through BL6. For example, the display surface is divided into (m×n) areas. A luminance value of a representative pixel in each area obtained at the time of lighting only a light source BLn at a determined lighting level is recorded in a tabular form. When a luminance value of each pixel is needed, it is calculated by interpolation calculation. Furthermore, a luminance value may be set in a corrected state in a light-source-specific LUT so as to accommodate luminance irregularity correction. By using such a light-source-specific LUT, luminance irregularity correction and lighting level determination are performed at the same time.

The tentative lighting level calculation unit 25 calculates a tentative lighting level of each light source BLn of the light source unit 52 on the basis of required luminance calculated by the image analysis unit 23 and a light-source-specific LUT. For example, the tentative lighting level calculation unit 25 tentatively sets a tentative lighting level, calculates luminance for a block in that state by the use of the light-source-specific LUT, compares the calculated luminance with the required luminance, and corrects the tentative lighting level. Alternatively, the tentative lighting level calculation unit 25 may find a tentative lighting level which satisfies the required luminance by calculation. The tentative lighting level calculation unit 25 outputs the calculated tentative lighting level to the lighting level determination unit 26.

The lighting level determination unit 26 selects the light sources BLn in order in accordance with calculation order designated by the calculation order change unit 27, and determines lighting levels of the light sources BLn. The lighting level determination unit 26 calculates estimated luminance for a block corresponding to a selected light source BLn by the use of a tentative lighting level of the selected light source BLn, a lighting level of a light source of the other light sources whose turn comes before the selected light source BLn in the calculation order, a tentative lighting level of a light source of the other light sources whose turn comes after the selected light source BLn in the calculation order, and light-source-specific LUTs. This estimated luminance means luminance estimated for the target block at the time of operating the light source unit 52 at the lighting level calculated at this point of time and tentative lighting levels. If the estimated luminance is lower than required luminance, then the lighting level determination unit 26 corrects the tentative lighting level according to the difference between the required luminance and the estimated luminance. If the estimated luminance satisfies the required luminance, then the lighting level determination unit 26 does not correct the tentative lighting level. If a tentative lighting level after the correction does not exceed a determined upper limit value, then the lighting level determination unit 26 sets this tentative lighting level as a lighting level of the selected light source BLn. If the tentative lighting level after the correction exceeds the determined upper limit value, then the lighting level determination unit 26 sets a lighting level of the selected light source BLn to the upper limit value. The lighting level determination unit 26 then calculates estimated luminance obtained at the time of lighting the selected light source BLn at the upper-limit lighting level, and makes up for luminance corresponding to the difference between the estimated luminance and the required luminance by tentative lighting levels of subsequent light sources in the calculation order. The lighting level determination unit 26 determines in this way an all light source lighting level SBL of the light sources BL0 through BL6 included in the light source unit 52, and outputs it to the light source drive section 60.

The calculation order change unit 27 switches at determined timing calculation order in which the lighting level determination unit 26 calculates a lighting level of a light source BLn. This prevents the lighting level determination unit 26 from calculating a lighting level of a light source BLn in the same calculation order.

The light source drive section 60 controls the light source unit 52 by the all light source lighting level SBL. Furthermore, the lighting level determination unit 26 calculates, on the basis of the light-source-specific LUTs, luminance information for the backlight 50 based on the determined all light source lighting level SBL, and outputs the luminance information for the backlight 50 to the display signal conversion unit 22. The display signal conversion unit 22 may correct a display signal SRGBW on the basis of the luminance information for the backlight 50.

Figure 6:
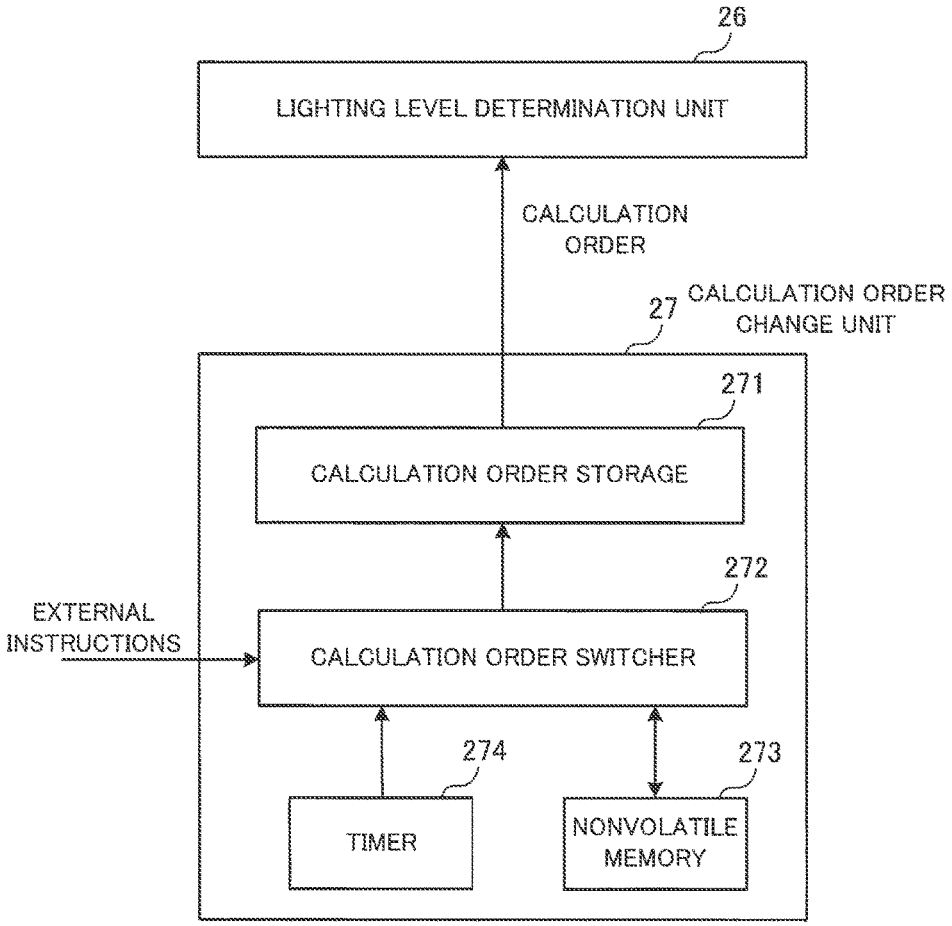
FIG. 6 illustrates an example of the structure of a calculation order change unit.

The calculation order change unit 27 will be described. FIG. 6 illustrates an example of the structure of the calculation order change unit. The calculation order change unit 27 includes calculation order storage 271, a calculation order switcher 272, a nonvolatile memory 273, and a timer 274.

The calculation order storage 271 stores calculation order in which a lighting level is determined. The lighting level determination unit 26 reads out the calculation order. For example, if the light sources BLn are brought into a line in the way illustrated in FIG. 3, then "BL0, BL1, BL2, BL3, BL4, BL5, and BL6" or "BL6, BL5, BL4, BL3, BL2, BL1, and BL0" is stored as the calculation order. A direction, such as a forward direction (from BL0 to BL6, for example) or a reverse direction (from BL6 to BL0), may be stored. The lighting level determination unit 26 reads out the calculation order stored in the calculation order storage 271, and determines a lighting level of a target light source BLn in order in accordance with the calculation order. The calculation order storage 271 may store a table in which several calculation order patterns are set and a calculation order pattern to be selected. The calculation order switcher 272 receives notice from the timer 274 or external instructions and switches calculation order. The external instructions are starting the display device 10, instructions to put the image display panel 30 into a sleep state, or the like. For example, the calculation order switcher 272 switches calculation order at the timing at which the image display panel 30 is switched from on to off or at the timing at which the image display panel 30 is switched from off to on. The nonvolatile memory 273 holds information even while power to the display device 10 is off. For example, the nonvolatile memory 273 stores a calculation order pattern which the calculation order switcher 272 selects last. The timer 274 measures a predetermined time. Each time the predetermined time elapses, the timer 274 sends notice to the calculation order switcher 272.

A case where the calculation order switcher 272 switches calculation order at the time of starting the display device 10 will be described as an example. The calculation order switcher 272 which receives the start of the display device 10 as external instructions reads out from the nonvolatile memory 273 a calculation order pattern used last. The calculation order switcher 272 then gives the lighting level determination unit 26 instructions to use as a calculation order pattern one of calculation order patterns stored in the calculation order storage 271 different from the calculation order pattern read out from the nonvolatile memory 273. For example, information indicative of a calculation order pattern to be selected is registered in advance in a determined area of the calculation order storage 271.

Furthermore, if the calculation order switcher 272 switches a calculation order pattern in a determined cycle, then the calculation order switcher 272 changes information indicative of a calculation order pattern each time the calculation order switcher 272 receives notice from the timer 274.

The nonvolatile memory 273 or the timer 274 may not be mounted as occasion arises.

The operation of the display device 10 having the above structure will be described.

When the display device 10 generates a display signal SRGBW from an image signal SRGB, the display device 10 improves the luminance of each pixel by using an expansion coefficient α as a conversion coefficient. To be concrete, each pixel 48 includes the fourth subpixel which outputs the fourth color. This extends the dynamic range of a value in reproduction HSV color space which can be reproduced by the display device 10. "H" represents hue, "S" represents saturation, and "V" represents a value. That is to say, the expansion coefficient α is used for expanding a value in HSV color space of the image signal SRGB based on the three primary colors into the reproduction HSV color space. As a result, the display signal SRGBW is calculated as an expanded image signal obtained by expanding the image signal SRGB into the reproduction HSV color space. For example, by using a value V(S) in which saturation S in the HSV color space is a variable and the maximum value Vmax(S) of a value in which saturation S in the reproduction HSV color space is a variable, the expansion coefficient α is expressed as $$\alpha(S)=V\max(S)/V(S) \quad (1)$$

Vmax(S) is found every time by the signal processing section 20. The display signal conversion unit 22 analyzes the image signal SRGB and finds an expansion coefficient α. The display signal conversion unit 22 calculates an expansion coefficient α for each pixel. On the basis of at least one of expansion coefficients α calculated for pixels in an arbitrary area, the display signal conversion unit 22 determines an expansion coefficient α for the arbitrary area. The arbitrary area may be a pixel or the entire display surface. The display signal conversion unit 22 then uses the expansion coefficient α for converting the image signal SRGB to a display signal SRGBW which is expanded into the reproduction HSV color space. The display signal conversion unit 22 corrects the display signal SRGBW after the conversion according to the luminance of the backlight 50 for a corresponding area.

The image analysis unit 23 analyzes the image signal SRGB according to blocks and calculates an expansion coefficient α for each block. Required luminance required for each block is 1/α which is the reciprocal of the expansion coefficient α. A block for which the image analysis unit 23 calculates an expansion coefficient α may not match an area for which the display signal conversion unit 22 calculates an expansion coefficient α.

As has been described, by using the expansion coefficient α for exercising division drive control of the backlight 50 and display control of the image display panel 30, the luminance of the backlight 50 is set to a minimum value by which the display device 10 can perform color reproduction in the reproduction HSV color space. As a result, the power consumption of the display device 10 is reduced.

Required luminance 1/α for each block calculated by the image analysis unit 23 by analyzing the image signal SRGB is inputted to the tentative lighting level calculation unit 25. On the basis of required luminance 1/α calculated for each block, the tentative lighting level calculation unit 25 calculates a tentative lighting level of each light source BLn.

Figure 7:
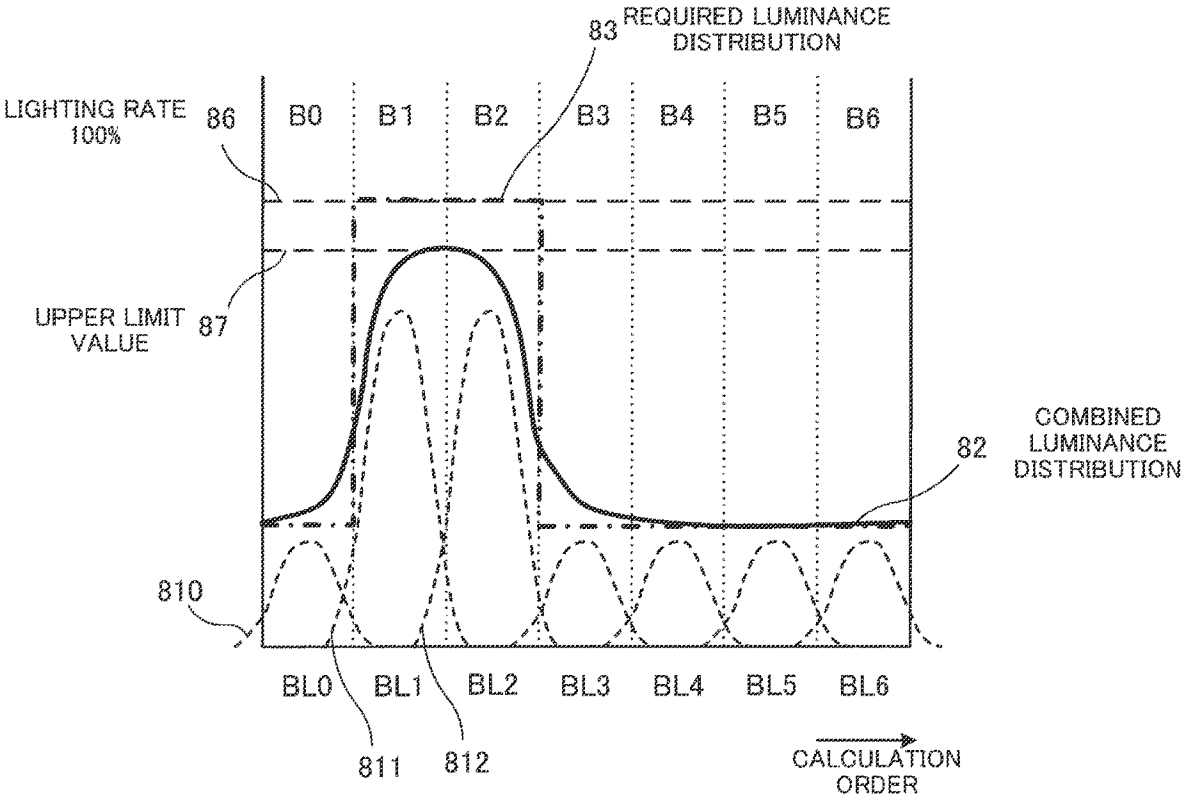
FIG. 7 illustrates an example of the relationship between a tentative lighting level and required luminance.

FIG. 7 illustrates an example of the relationship between a tentative lighting level and required luminance. FIG. 7 illustrates luminance distribution in the LY direction in an area of the backlight 50 obtained on the assumption that all the light sources of the light source unit 52 are lit at tentative lighting levels. In FIG. 7, a horizontal axis indicates the arrangement of the light sources BLn and a vertical axis indicates a lighting rate. Furthermore, the lighting rate 100(%) 86 corresponds to a peak value of drive current by which a light source BLn is driven. An upper limit value 87 is set as the maximum value of drive current by which a light source BLn is driven, and is set in the range of a value which is not smaller than the maximum luminance obtained by an image signal SRGB to a peak value of drive current by which the light source BLn is driven.

On the basis of the required luminance distribution 83, the tentative lighting level calculation unit 25 calculates a tentative lighting level of each light source BLn so as to satisfy required luminance for each block. Luminance distribution 810 indicates luminance distribution obtained by a tentative lighting level of the light source BL0 corresponding to the block B0. The same luminance distribution is obtained for each of the light sources BL3, BL4, BL5, and BL6. Luminance distribution 811 obtained by a tentative lighting level of the light source BL1 corresponding to the block B1 and luminance distribution 812 obtained by a tentative lighting level of the light source BL2 corresponding to the block B2 are higher than the luminance distribution indicated for the other light sources. Luminance distribution obtained for each light source BLn also spreads to the outside of a corresponding block. The luminance of the entire screen of the backlight 50 is obtained by adding the luminance distribution obtained for the light sources BLn. In FIG. 7, the luminance distribution of the screen is indicated by combined luminance distribution 82.

The lighting level determination unit 26 calculates combined luminance from a tentative lighting level of each light source BLn and the light-source-specific LUTs and compares combined luminance and required luminance for each block. Combined luminance is estimated luminance which will be obtained on the assumption that each light source BLn is lit at a tentative lighting level. The lighting level determination unit 26 compares combined luminance and required luminance for a block corresponding to each light source BLn in accordance with calculation order, corrects a tentative lighting level of a light source BLn corresponding to a block for which combined luminance does not satisfy required luminance, and determines a lighting level. In the example of FIG. 7, the calculation order of the light sources BL0, BL1, BL2, BL3, BL4, BL5, and BL6 is adopted.

First the lighting level determination unit 26 compares combined luminance and required luminance for the block B0 corresponding to the light source BL0. The combined luminance is higher than the required luminance for the block B0. Therefore, the lighting level determination unit 26 set a tentative lighting level as a lighting level. Combined luminance is lower than required luminance for the block B1 corresponding to the light source BL1. Therefore, the lighting level determination unit 26 corrects a tentative lighting level of the light source BL1.

Figure 8:
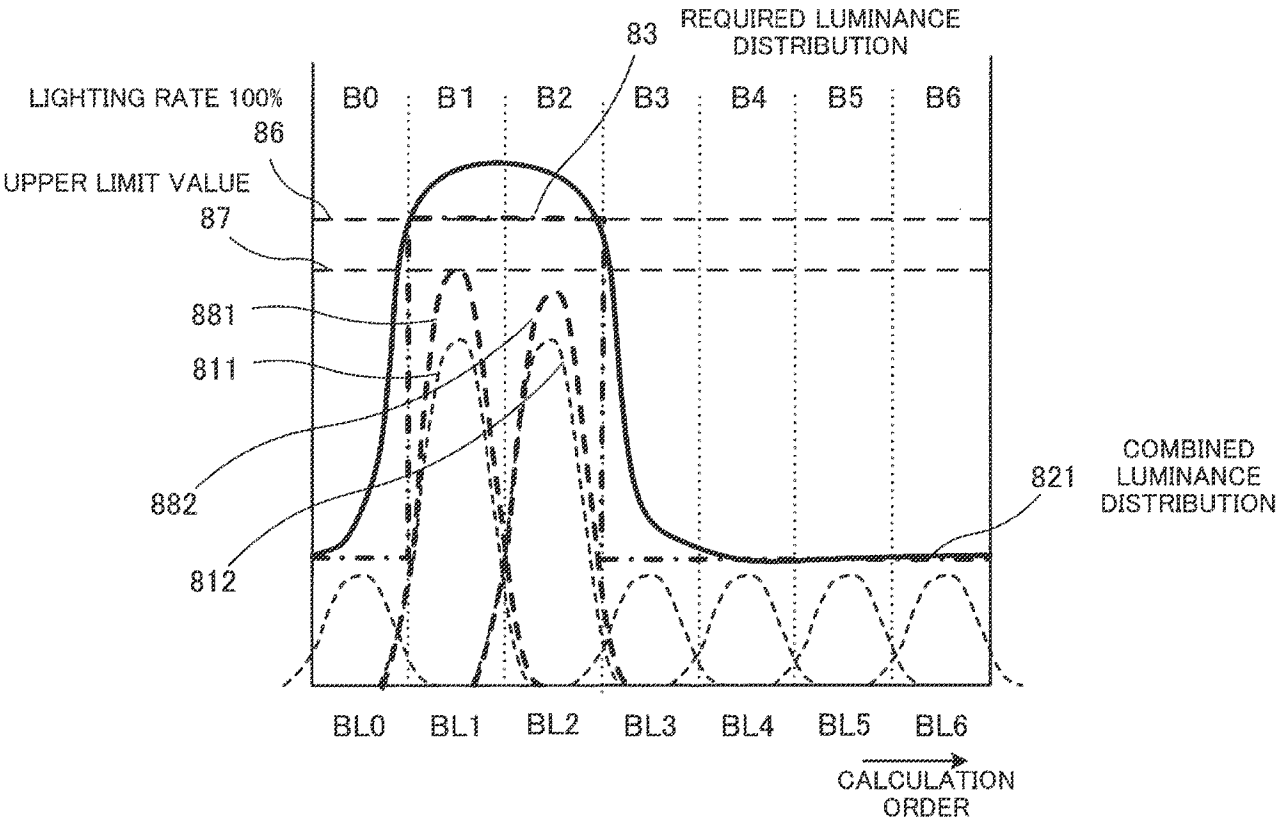
FIG. 8 is a view for describing a process for correcting a lighting level of a light source.

A process performed for the next block B1 will be described by the use of FIG. 8. FIG. 8 is a view for describing a process for correcting a lighting level of a light source. Elements in FIG. 8 which are the same as those indicated in FIG. 7 are marked with the same numerals and descriptions of them will be omitted. The lighting level determination unit 26 corrects the tentative lighting level of the light source BL1 according to the difference between the combined luminance and the required luminance, that is to say, a deficiency in luminance for the block B1. For example, the lighting level determination unit 26 calculates a correction amount by finding a lighting level by which the deficiency in luminance is made up for by the use of the light-source-specific LUT. The lighting level determination unit 26 raises in this way luminance distribution obtained by the light source BL1 from luminance distribution 811 obtained by the original tentative lighting level of the light source BL1 to luminance distribution 881 after the correction. The upper limit of a tentative lighting level is an upper limit value 87. Therefore, a tentative lighting level of the light source BL1 is limited to the upper limit value 87. At this time a deficiency in luminance is made up for by the light source BL2 whose turn comes next in the calculation order. For example, the lighting level determination unit 26 calculates combined luminance obtained at the time of lighting the light source BL1 at the upper limit value 87, and calculates a lighting level of the light source BL2 which satisfies the required luminance for the block B1. A correction amount of a tentative lighting level is found by the use of, for example, the light-source-specific LUT. The lighting level determination unit 26 raises luminance distribution by the light source BL2 in this way from luminance distribution 812 obtained by the original tentative lighting level of the light source BL2 to luminance distribution 882 after the correction. Combined luminance distribution 821 based on the tentative lighting levels after the correction is higher than required luminance distribution 83. The combined luminance distribution 821 is higher than the required luminance distribution 83 for the following blocks B3, B4, B5, and B6. Accordingly, a tentative lighting level is set as a lighting level without correction.

As indicated in FIG. 8, there is a tendency for the tentative lighting level of the light source BL1 whose turn comes before the light source BL2 in the calculation order to become higher than the tentative lighting level of the light source BL2 whose turn comes after the light source BL1.

Figure 9:
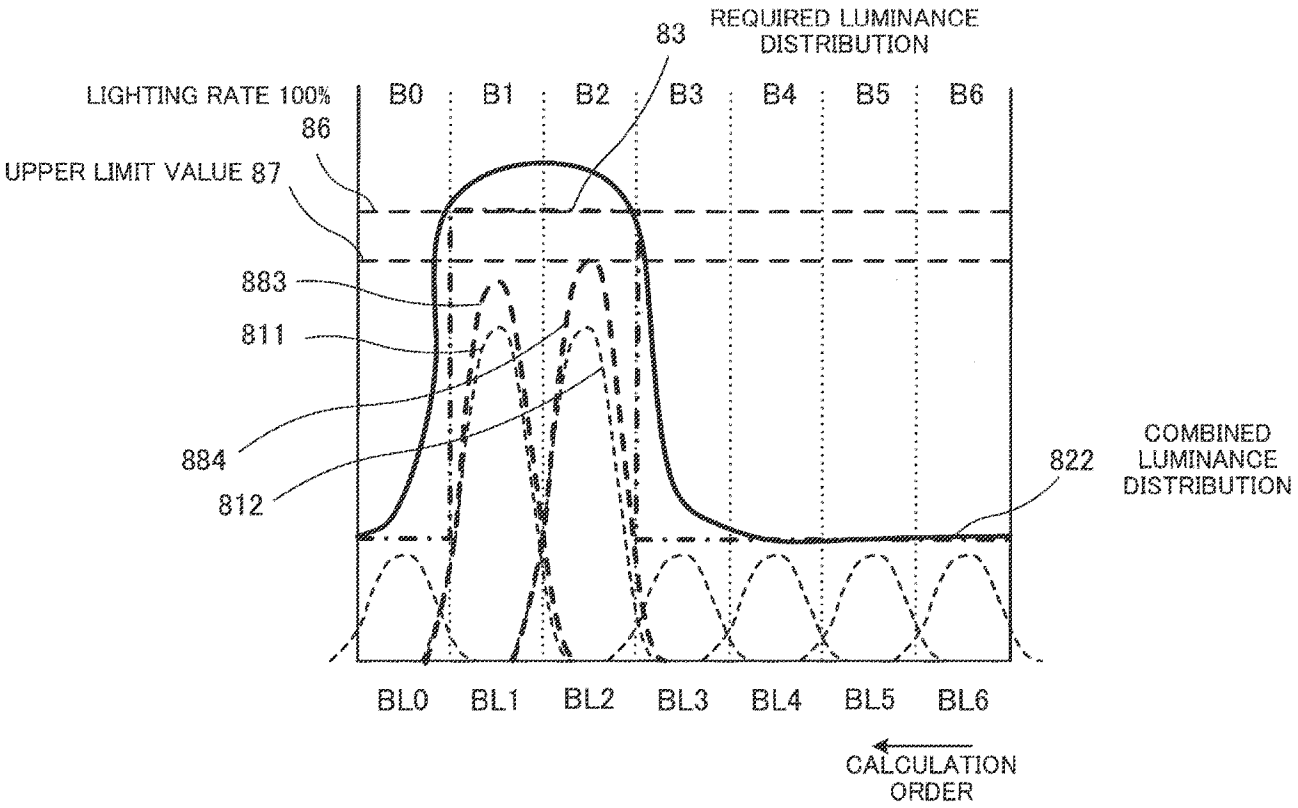
FIG. 9 is a view for describing a process for correcting a lighting level of a light source which is performed in calculation order reverse to that indicated in FIG. 8.

A case where the calculation order is reversed will now be described. FIG. 9 is a view for describing a process for correcting a lighting level of a light source which is performed in calculation order reverse to that indicated in FIG. 8.

The lighting level determination unit 26 selects the light sources BL6, BL5, BL4, and BL3 in order in accordance with the calculation order and performs a correction process. Combined luminance is higher than required luminance for the light sources BL6, BL5, BL4, and BL3. Therefore, a tentative lighting level is set as a lighting level. As indicated in FIG. 7, the combined luminance does not satisfy the required luminance for the block B2 corresponding to the next light source BL2. Accordingly, the lighting level determination unit 26 corrects the tentative lighting level of the light source BL2. The lighting level determination unit 26 corrects the tentative lighting level of the light source BL2 on the basis of a deficiency in luminance corresponding to the difference between combined luminance and required luminance for the block B2. For example, the lighting level determination unit 26 calculates a correction amount of the tentative lighting level by finding a lighting level by which the deficiency in luminance for the block B2 is made up for by the use of the light-source-specific LUT. The lighting level determination unit 26 raises luminance distribution by the light source BL2 in this way from luminance distribution 812 obtained by the original tentative lighting level of the light source BL2 to luminance distribution 884 after the correction. The upper limit of a tentative lighting level is an upper limit value 87. Therefore, a tentative lighting level of the light source BL2 is limited to the upper limit value 87. At this time a deficiency in luminance is made up for by the light source BL1 whose turn comes next in the calculation order. Next, the lighting level determination unit 26 corrects a tentative lighting level of the light source BL1 according to the difference between combined luminance and required luminance for the block B1 corresponding to the light source BL1. For example, the lighting level determination unit 26 finds a correction amount of the tentative lighting level by the use of the light-source-specific LUT. The lighting level determination unit 26 raises luminance distribution by the light source BL1 in this way from luminance distribution 811 obtained by the original tentative lighting level of the light source BL1 to luminance distribution 883 after the correction. Combined luminance distribution 822 based on the tentative lighting levels after the correction is higher than required luminance distribution 83.

As indicated in FIG. 9, there is a tendency for the tentative lighting level of the light source BL2 whose turn comes before the light source BL1 in the calculation order to become higher than the tentative lighting level of the light source BL1 whose turn comes after the light source BL2.

With the display device 10 the calculation order change unit 27 switches calculation order at determined timing. For example, the calculation order change unit 27 performs switching between the calculation order indicated in FIG. 8 and the calculation order indicated in FIG. 9 at determined timing. This reduces non-uniformity of lighting levels of the light sources BLn caused by the tendency of a lighting level of a light source BLn whose turn comes earlier in calculation order to become higher.

Figure 10:
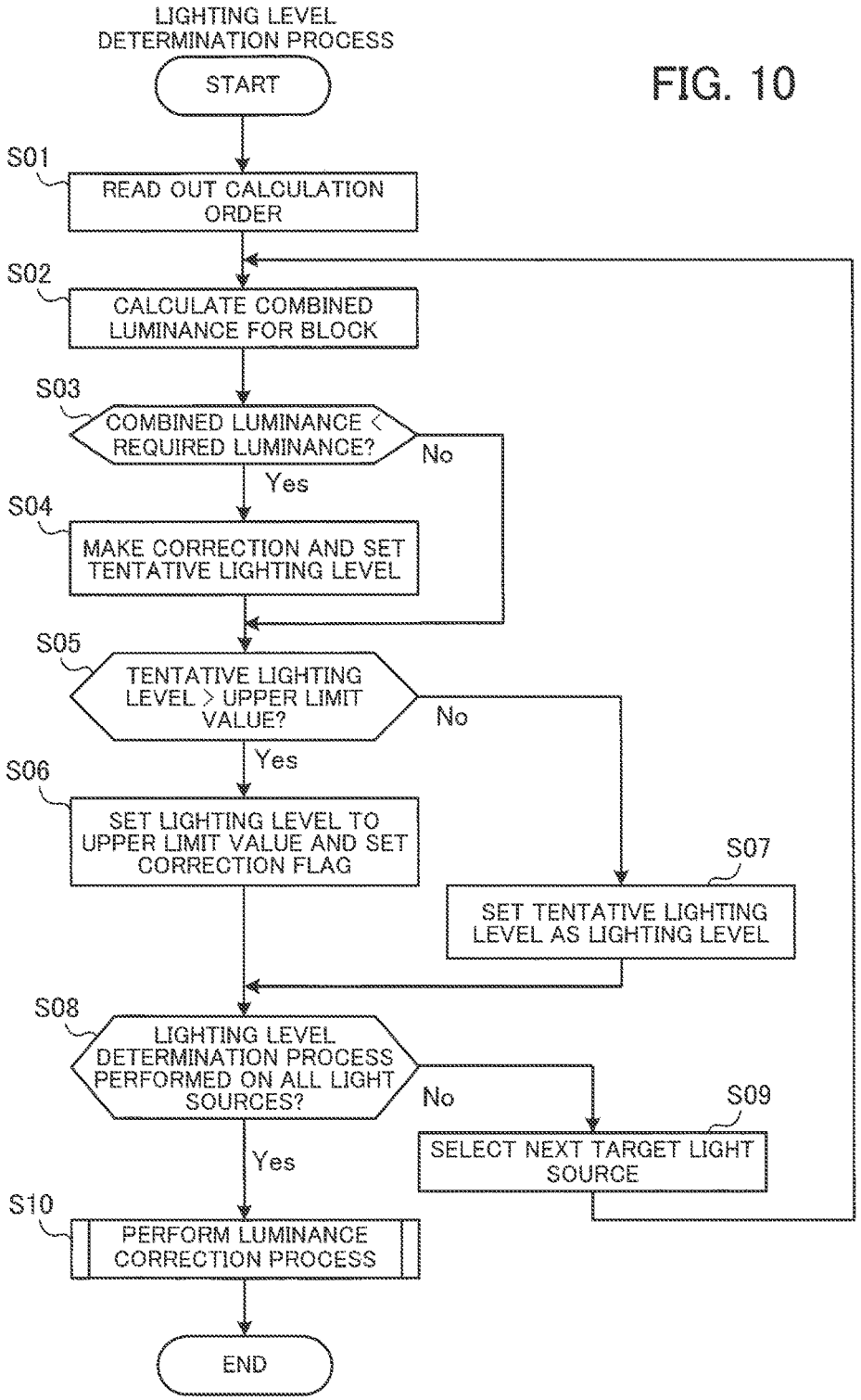
FIG. 10 is a flow chart of a procedure for a lighting level determination process in the second embodiment.

A procedure for a lighting level determination process will now be described by the use of a flow chart. FIG. 10 is a flow chart of a procedure for a lighting level determination process in the second embodiment.

(Step S01) The lighting level determination unit 26 reads out calculation order stored in the calculation order storage 271 and selects a target light source BLn from among a plurality of light sources on the basis of the calculation order which the lighting level determination unit 26 reads out.

(Step S02) The lighting level determination unit 26 calculates combined luminance for a block corresponding to the selected light source BLn on the basis of a tentative lighting level of the selected light source BLn, a tentative lighting level or a determined lighting level of another light source, and light-source-specific LUTs.

(Step S03) The lighting level determination unit 26 compares the calculated combined luminance and required luminance for the block corresponding to the selected light source BLn to determine whether or not the calculated combined luminance is lower than the required luminance. If the calculated combined luminance satisfies the required luminance, then the lighting level determination unit 26 proceeds to step S05. If the calculated combined luminance is lower than the required luminance, then the lighting level determination unit 26 proceeds to step S04.

(Step S04) The lighting level determination unit 26 makes a correction according to the difference between the required luminance and the combined luminance and sets a tentative lighting level of the light source BLn which satisfies the required luminance.

(Step S05) The lighting level determination unit 26 determines whether or not the tentative lighting level of the light source BLn is higher than the upper limit value of a lighting level. If the tentative lighting level of the light source BLn is higher than the upper limit value of a lighting level, then the lighting level determination unit 26 proceeds to step S06. If the tentative lighting level of the light source BLn is not higher than the upper limit value of a lighting level, then the lighting level determination unit 26 proceeds to step S07.

(Step S06) The lighting level determination unit 26 sets a lighting level of the light source BLn to the upper limit value, sets a correction flag, and proceeds to step S08.

(Step S07) The lighting level determination unit 26 sets the tentative lighting level of the light source BLn as a lighting level of the light source BLn.

(Step S08) The lighting level determination unit 26 determines whether or not the lighting level determination process has been performed on all the light sources. If the lighting level determination unit 26 determines that lighting levels of all the light sources have been determined, then the lighting level determination unit 26 proceeds to step S10. If the lighting level determination unit 26 determines that lighting levels of all the light sources have not been determined, then the lighting level determination unit 26 proceeds to step S09.

(Step S09) The lighting level determination unit 26 selects the next target light source on the basis of the calculation order stored in the calculation order storage 271, and proceeds to step S02.

(Step S10) The lighting level determination unit 26 performs a luminance correction process and then ends the lighting level determination process.

Figure 11:
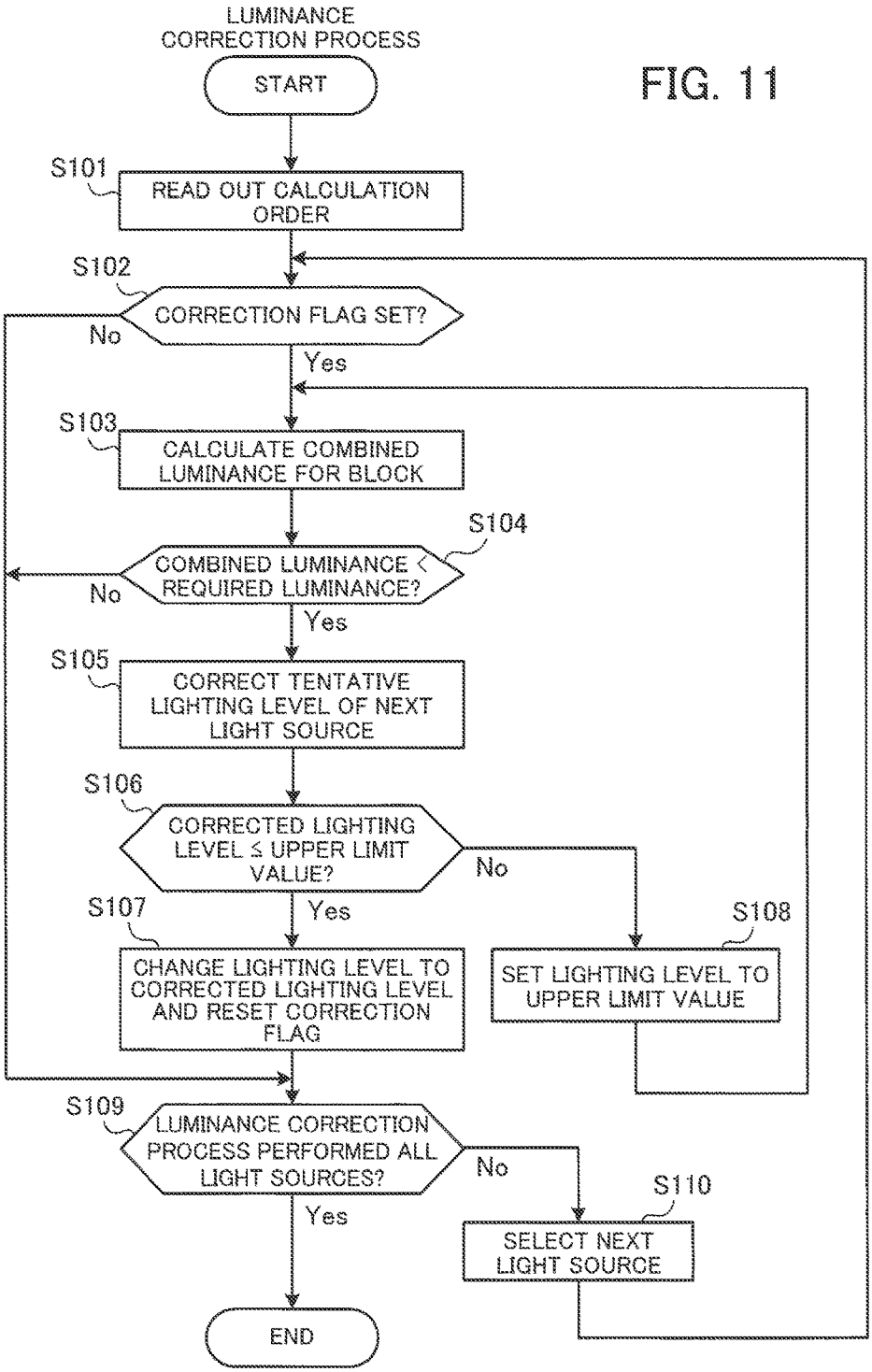
FIG. 11 is a flow chart of a procedure for a luminance correction process in the second embodiment.

FIG. 11 is a flow chart of a procedure for the luminance correction process in the second embodiment.

(Step S101) The lighting level determination unit 26 reads out the calculation order stored in the calculation order storage 271 and selects a target light source BLn from among the plurality of light sources on the basis of the calculation order which the lighting level determination unit 26 reads out.

(Step S102) The lighting level determination unit 26 determines whether or not a correction flag is set on the target light source BLn. The target light source BLn on which a correction flag is set indicates that because its lighting level is limited to the upper limit value, there is a deficiency in luminance and that another light source makes up for the deficiency in luminance. If a correction flag is set on the target light source BLn, then the lighting level determination unit 26 proceeds to step S103. If a correction flag is not set on the target light source BLn, then the lighting level determination unit 26 proceeds to step S109.

(Step S103) The lighting level determination unit 26 calculates combined luminance for a block corresponding to the selected light source BLn.

(Step S104) The lighting level determination unit 26 compares the calculated combined luminance and required luminance for the block corresponding to the selected light source BLn to determine whether or not the calculated combined luminance is lower than the required luminance. At this time the lighting level determination unit 26 takes into consideration a case where the required luminance for the block corresponding to the selected light source BLn is ensured by a lighting level determination process performed after the correction flag is set on the light source BLn. If the calculated combined luminance satisfies the required luminance, then the lighting level determination unit 26 proceeds to step S109. If the calculated combined luminance is lower than the required luminance, then the lighting level determination unit 26 proceeds to step S105.

(Step S105) The lighting level determination unit 26 calculates a lighting level of a next light source whose turn comes next in the calculation order by which a deficiency in luminance corresponding to the difference between the combined luminance and the required luminance for the block corresponding to the selected light source BLn is made up for. By doing so, the lighting level determination unit 26 corrects a tentative lighting level of the next light source. A tentative lighting level of a next light source is corrected in order in this way in accordance with the calculation order. For example, if the deficiency in luminance is not made up for by the light source BL(n+1) whose turn comes next to the selected light source BLn in the calculation order, then the deficiency in luminance is made up for by the light source BL(n+2) whose turn comes next to the light source BL(n+1) in the calculation order. On the basis of a light-source-specific LUT for the next light source, the lighting level determination unit 26 calculates a corrected lighting level by which the difference between the combined luminance and the required luminance for the block corresponding to the selected light source BLn is made up for.

(Step S106) The lighting level determination unit 26 compares the corrected lighting level and the upper limit value to determine whether or not the corrected lighting level is higher than the upper limit value. If the corrected lighting level is not higher than the upper limit value, then the lighting level determination unit 26 proceeds to step S107. If the corrected lighting level is higher than the upper limit value, then the lighting level determination unit 26 proceeds to step S108.

(Step S107) The lighting level determination unit 26 changes a lighting level to the corrected lighting level, resets the correction flag, and proceeds to step S109.

(Step S108) The lighting level determination unit 26 sets a lighting level to the upper limit value and proceeds to step S103.

(Step S108) The lighting level determination unit 26 sets a lighting level to the upper limit value and proceeds to step S103.

(Step S109) The lighting level determination unit 26 determines whether or not the luminance correction process has been performed on all light sources. If there remains a light source on which a correction flag is set after the round of the calculation order, then the lighting level determination unit 26 considers that the luminance correction process has not been performed on all the light sources, and reverses the calculation order. If the lighting level determination unit 26 determines that lighting levels of all the light sources have been corrected, then the lighting level determination unit 26 ends the luminance correction process. If the lighting level determination unit 26 determines that lighting levels of all the light sources have not been corrected, then the lighting level determination unit 26 proceeds to step S110.

(Step S110) The lighting level determination unit 26 selects the next target light source on the basis of the calculation order stored in the calculation order storage 271, and proceeds to step S102.

The lighting level determination process is performed through the above procedures.

The maximum lighting level of each light source is limited to the upper limit value as a result of the above lighting level determination process. For example, a heavy load is applied to a light source at the time when its tentative lighting level is calculated. A lighting level of this light source is reduced and a deficiency in luminance is made up for by a light source whose turn comes next in calculation order. By doing so, a load on each light source is reduced. Furthermore, required luminance is made up for by the luminance of another light source. Therefore, image quality degradation does not occur and a load on each light source is reduced.

In the above second embodiment the light sources included in the light source unit 52 are brought into a line along one side of the backlight 50. However, the present disclosure is not limited to this arrangement method.

Figure 12:
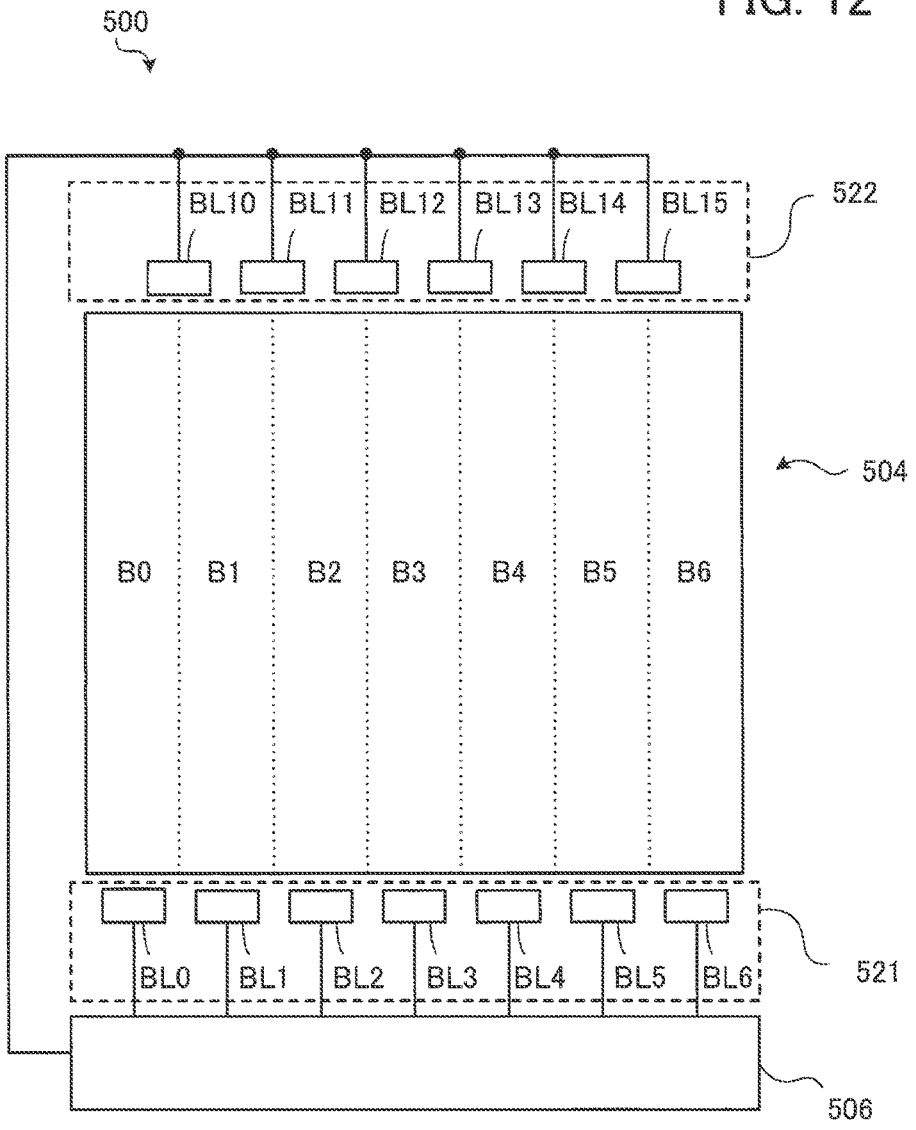
FIG. 12 illustrates a second example of the arrangement of light sources in the second embodiment.

FIG. 12 illustrates a second example of the arrangement of light sources in the second embodiment. A backlight 500 illustrated in FIG. 12 includes a first light source unit 521 and a second light source unit 522 with a light guide plate 504 therebetween and a light source drive section 506.

In the first light source unit 521, light sources BL0, BL1, BL2, BL3, BL4, BL5, and BL6 are arranged along a side of the light guide plate 504. In the second light source unit 522, light sources BL10, BL11, BL12, BL13, BL14, and BL15 are arranged along a side of the light guide plate 504 opposite the first light source unit 521 with the light guide plate 504 therebetween. In the example of FIG. 12, the light source BL10 of the second light source unit 522 is arranged opposite a portion between the light sources BL0 and BL1 of the first light source unit 521 and the light source BL11 is arranged opposite a portion between the light sources BL1 and BL2.

The lighting level determination unit 26 determines lighting levels of the first light source unit 521 and the second light source unit 522 in accordance with calculation order set by the calculation order change unit 27. Patterns of calculation order for the light sources BLn are registered in the calculation order storage 271 of the calculation order change unit 27. For example, the following pattern is possible. Lighting levels of the light sources BL0, BL1, BL2, BL3, BL4, BL5, and BL6 included in the first light source unit 521 are calculated in that order and then lighting levels of the light sources BL10, BL11, BL12, BL13, BL14, and BL15 included in the second light source unit 522 are calculated in that order. Furthermore, the following pattern may be adopted. The light sources BLn included in the first light source unit 521 are selected alternately with the light sources BLn included in the second light source unit 522 to calculate their lighting levels. For example, lighting levels of the light sources BL0, BL10, BL1, BL11, and so on are calculated in that order.

Figure 13:
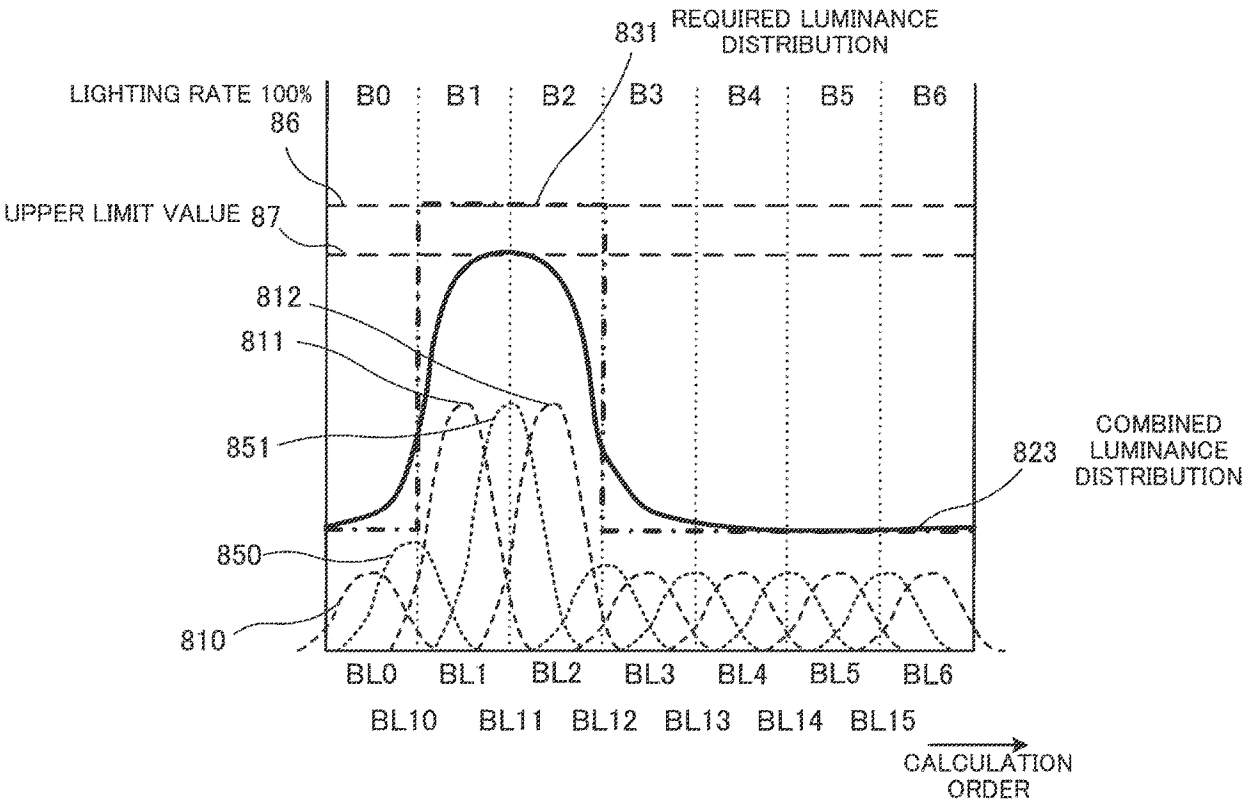
FIG. 13 illustrates an example of the relationship between a tentative lighting level and required luminance in the second example of the arrangement of light sources.

FIG. 13 illustrates an example of the relationship between a tentative lighting level and required luminance in the second example of the arrangement of light sources. Elements in FIG. 13 which are the same as those indicated in FIG. 7 are marked with the same numerals and descriptions of them will be omitted. FIG. 13 indicates luminance distribution detected, for example, at the intermediate points between the first light source unit 521 and the second light source unit 522.

The tentative lighting level calculation unit 25 calculates a tentative lighting level of each light source BLn on the basis of required luminance distribution 831. Luminance distribution 810 indicates luminance distribution obtained by lighting the light source BL0 at a tentative lighting level. The same luminance distribution is obtained for each of the light sources BL3, BL4, BL5, and BL6. Luminance distribution 811 obtained by a tentative lighting level of the light source BL1 corresponding to a block B1 and luminance distribution 812 obtained by a tentative lighting level of the light source BL2 corresponding to a block B2 are higher than the luminance distribution indicated for the other light sources. Furthermore, luminance distribution 850 is obtained by lighting the light source BL10 at a tentative lighting level and luminance distribution 851 is obtained by lighting the light source BL11 at a tentative lighting level. Tentative lighting levels are calculated in the same way for the other light sources BL12, BL13, BL14, and BL15 included in the second light source unit 522. Luminance distribution obtained for each light source BLn also spreads to the outside of a corresponding block. The luminance of the entire screen of the backlight 500 is obtained by adding the luminance distribution obtained for the light sources BLn. In FIG. 13, the luminance distribution of the screen is indicated by combined luminance distribution 823.

The lighting level determination unit 26 calculates combined luminance from a tentative lighting level of each light source BLn and the light-source-specific LUTs and compares combined luminance and required luminance for each block. The lighting level determination unit 26 compares combined luminance and required luminance for a block corresponding to each light source BLn in accordance with calculation order, corrects a tentative lighting level of a light source BLn corresponding to a block for which combined luminance does not satisfy required luminance, and determines a lighting level. In the example of FIG. 13, the calculation order of the light sources BL0, BL10, BL1, BL11, BL2, BL12, BL3, BL13, BL4, BL14, BL5, BL15, and BL6 is adopted.

In the case of the above light source arrangement, the lighting level determination unit 26 also determines a lighting level of each light source in accordance with calculation order set by the calculation order change unit 27. In addition, the calculation order change unit 27 changes calculation order at determined timing. As a result, even in the case of the above light source arrangement, non-uniformity of lighting levels is reduced.

Third Embodiment

The hardware configuration of a display device according to a third embodiment is the same as that of the display device according to the second embodiment illustrated in FIGS. 2 and 3. With a display device according to a third embodiment a process for correcting a lighting level of a light source is performed for reducing the influence of a failure in a light source.

Figure 14:
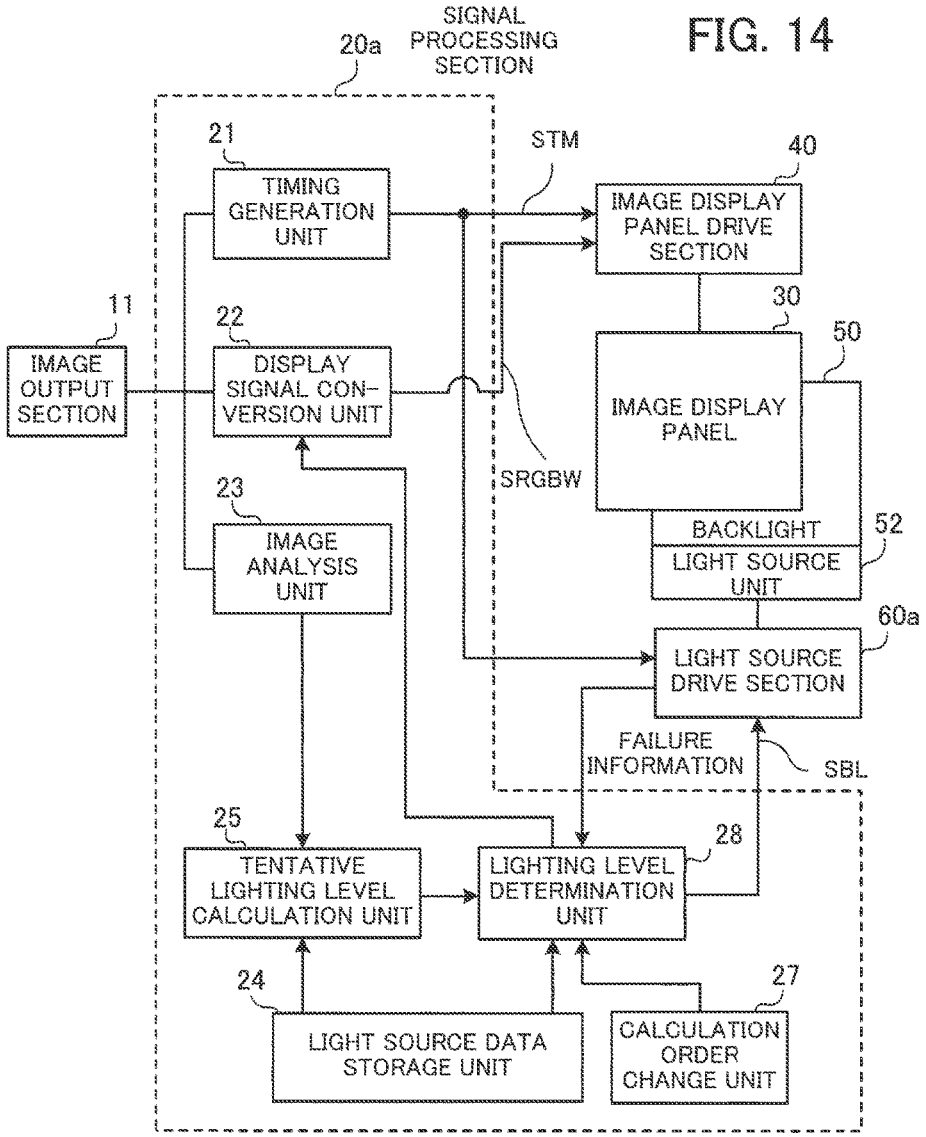
FIG. 14 is a functional block diagram of a signal processing section included in a display device according to a third embodiment.

FIG. 14 is a functional block diagram of a signal processing section included in a display device according to a third embodiment. Components in FIG. 14 which are the same as those included in the display device according to the second embodiment illustrated in FIG. 5 are marked with the same numerals and descriptions of them will be omitted.

A signal processing section 20*a* and a light source drive section 60*a* included in a display device according to a third embodiment differ from the signal processing section 20 and the light source drive section 60, respectively, included in the display device according to the second embodiment.

The signal processing section 20*a* includes a timing generation unit 21, a display signal conversion unit 22, an image analysis unit 23, a light source data storage unit 24, a tentative lighting level calculation unit 25, a calculation order change unit 27, and a lighting level determination unit 28. The lighting level determination unit 28 differs from the lighting level determination unit 26 included in the signal processing section 20 in the second embodiment. The light source drive section 60*a* drives a light source BLn on the basis of a lighting level of the light source BLn determined by the lighting level determination unit 28. In addition, the light source drive section 60*a* monitors the operating state of a light source BLn. When the light source drive section 60*a* detects a failure in the light source BLn, the light source drive section 60*a* informs the lighting level determination unit 28 of it as failure information. The light source drive section 60*a* is an example of a failure detector which detects a failure in a light source.

The lighting level determination unit 28 selects light sources BLn in order in accordance with calculation order designated by the calculation order change unit 27, and determines lighting levels of the light sources BLn. The calculation order change unit 27 changes the calculation order at determined timing. When the lighting level determination unit 28 acquires failure information for a light source BLn from the light source drive section 60*a*, the lighting level determination unit 28 considers a lighting level of the light source BLn for which the lighting level determination unit 28 acquires the failure information to be zero, and selects in order the light sources BLn other than the light source BLn for which the lighting level determination unit 28 acquires the failure information in accordance with the calculation order. Hereinafter the failed light source BLn will be indicated by EBLn. In addition, the lighting level determination unit 28 raises the upper limit value of a lighting level. The reason for this is to suppose a case where it is impossible to make up for the luminance of the failed light source EBLn whose lighting level is zero by the usual upper limit value of another light source BLn. There is a proper value for a raised upper limit value of a lighting level according to the structure of the display device 10 such as the number of light sources. Accordingly, it is desirable to save the raised upper limit value in a rewritable memory such as a nonvolatile memory 273 included in the calculation order change unit 27.

The lighting level determination unit 28 calculates estimated luminance for a block corresponding to a selected light source BLn by the use of a tentative lighting level of the selected light source BLn, a lighting level of a light source BLn of the other light sources BLn whose turn comes before the selected light source BLn in the calculation order, a tentative lighting level of a light source BLn of the other light sources BLn whose turn comes after the selected light source BLn in the calculation order, and light-source-specific LUTs. If the estimated luminance is lower than required luminance, then the lighting level determination unit 28 corrects the tentative lighting level according to the difference between the required luminance and the estimated luminance. If the estimated luminance satisfies the required luminance, then the lighting level determination unit 28 does not correct the tentative lighting level. If a tentative lighting level after the correction does not exceed the determined upper limit value, then the lighting level determination unit 28 sets this tentative lighting level as a lighting level of the selected light source BLn. If the tentative lighting level after the correction exceeds the determined upper limit value, then the lighting level determination unit 28 sets a lighting level of the selected light source BLn to the upper limit value. The lighting level determination unit 28 then calculates estimated luminance obtained at the time of lighting the selected light source BLn at the upper-limit lighting level, and makes up for luminance corresponding to the difference between the estimated luminance and the required luminance by tentative lighting levels of subsequent light sources in the calculation order. The lighting level determination unit 28 determines in this way an all light source lighting level SBL of light sources BL0 through BL6 included in a light source unit 52, and outputs it to the light source drive section 60*a*.

Figure 15:
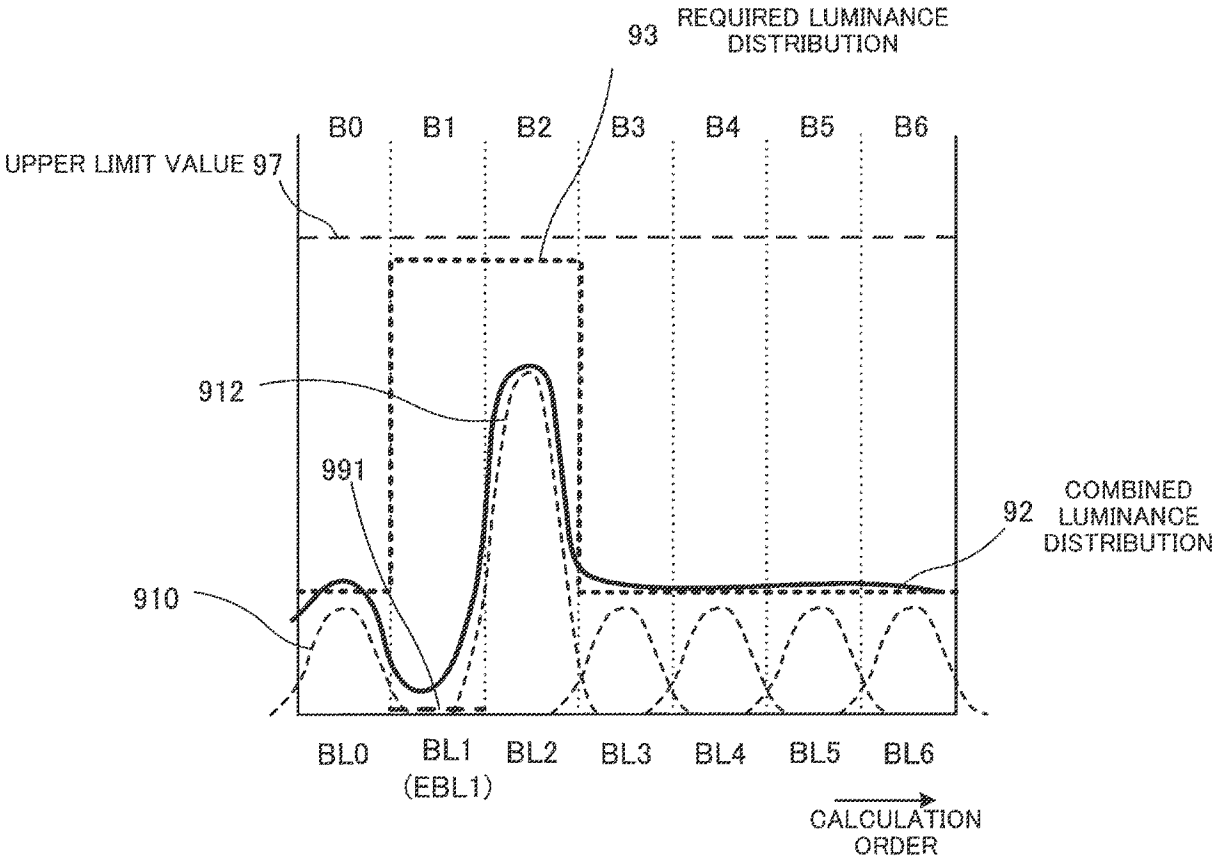
FIG. 15 illustrates an example of the relationship between a tentative lighting level and required luminance in the third embodiment.

FIG. 15 illustrates an example of the relationship between a tentative lighting level and required luminance in the third embodiment. Elements in FIG. 15 which are the same as those indicated in FIG. 7 are marked with the same numerals and descriptions of them will be omitted.

The tentative lighting level calculation unit 25 calculates a tentative lighting level of each light source BLn so as to satisfy required luminance distribution 93 indicated in FIG. 15. FIG. 15 indicates luminance distribution 910 obtained by lighting the light source BL0 corresponding to a block B0 at a tentative lighting level calculated by the tentative lighting level calculation unit 25. The same luminance distribution is obtained for each of the light sources BL3, BL4, BL5, and BL6. Similarly, the tentative lighting level calculation unit 25 calculates a tentative lighting level which satisfies required luminance for blocks B1 and B2 on the basis of luminance distribution 912 obtained by a tentative lighting level of the light source BL2 corresponding to the block B2 and the light source BL1 corresponding to the block B1. It is assumed that failure information for the light source BL1 is inputted from the light source drive section 60*a* to the lighting level determination unit 28. The lighting level determination unit 28 treats the light source BL1 as a failed light source EBL1 and considers its lighting level to be zero. FIG. 15 indicates luminance distribution 991 obtained by considering a lighting level of the failed light source EBL1 to be zero. The luminance of the entire screen of a backlight 50 is obtained by adding the luminance distribution obtained for the light sources BLn. With combined luminance distribution 92 indicated in FIG. 15, luminance falls at a portion corresponding to the block B1. As a result, required luminance distribution 93 is not satisfied for blocks B1 and B2.

Description will be given on the assumption that the lighting level determination unit 28 performs a process in order from the light source BL0. The lighting level determination unit 28 compares required luminance for the block B0 corresponding to the light source BL0 and combined luminance calculated on the basis of tentative lighting levels of all the light sources. In this case, the combined luminance satisfies the required luminance. Therefore, the lighting level determination unit 28 sets the tentative lighting level as a lighting level. The lighting level "0" of the light source BL1 is reflected in the combined luminance distribution 92 indicated in FIG. 15. The combined luminance calculated on the basis of the tentative lighting levels of all the light sources is higher than the required luminance distribution 93 for the block B0. The light source BL1 whose turn comes next in the calculation order has failed. Accordingly, the lighting level determination unit 28 sets a lighting level of the light source BL1 to 0 and raises an upper limit value 97. The lighting level determination unit 28 compares required luminance for the block B2 corresponding to the next light source BL2 and the combined luminance, detects that the combined luminance is lower than the required luminance, and corrects the tentative lighting level.

Figure 16:
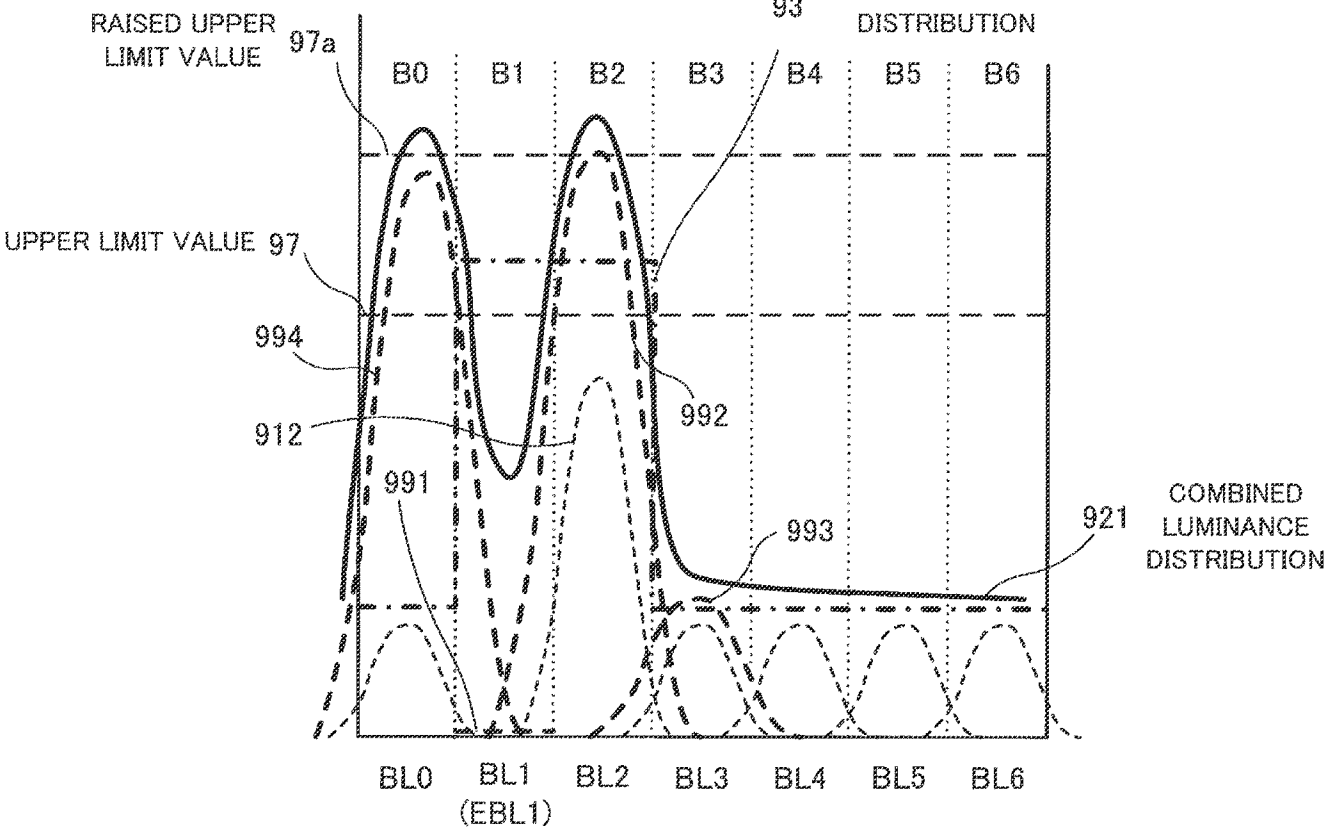
FIG. 16 is a view for describing a process in the third embodiment for correcting a lighting level of a light source.

FIG. 16 is a view for describing a process in the third embodiment for correcting a lighting level of a light source. Elements in FIG. 16 which are the same as those indicated in FIG. 15 are marked with the same numerals and descriptions of them will be omitted. The upper limit value 97 is raised to a raised upper limit value 97*a*. The lighting level determination unit 28 makes a correction by adding a lighting level by which the difference between the required luminance and the combined luminance is made up for to the tentative lighting level of the light source BL2. In the example of FIG. 16, a tentative lighting level exceeds the raised upper limit value 97*a*. Therefore, the lighting level determination unit 28 determines the raised upper limit value 97*a* as a lighting level. Luminance distribution 992 is obtained by lighting the light source BL2 at the determined lighting level. The lighting level determination unit 28 corrects the tentative lighting level of the light source BL3 whose turn comes next in the calculation order so as to make up for a deficiency in luminance caused by limiting a lighting level of the light source BL2 to the raised upper limit value 97*a*, and determines a lighting level of the light source BL3. Luminance distribution 993 is obtained by lighting the light source BL3 at the lighting level after the correction. Combined luminance does not satisfy required luminance yet for the block B1 at the time when the lighting level determination unit 28 has performed a process on the light source BL6. Therefore, the lighting level determination unit 28 performs a process in order reverse to the calculation order. The light source BL1 has failed. Accordingly, the lighting level determination unit 28 calculates a lighting level of the light source BL0 whose turn comes next in the calculation order so as to make up for a deficiency in luminance corresponding to the difference between the required luminance and the combined luminance for the block B1. In the example of FIG. 16, the lighting level determination unit 28 increases a lighting level of the light source BL0 corresponding to the block B0 until the combined luminance exceeds the required luminance for the block B1. Luminance distribution 994 is obtained by lighting the light source BL0 at a lighting level after the correction. By performing the above processes, combined luminance distribution 921 is obtained.

As has been described, the lighting level determination unit 28 reduces a deficiency in luminance caused by a failure in a light source. A procedure for processes performed by the lighting level determination unit 28 will be described by the use of flow charts.

Figure 17:
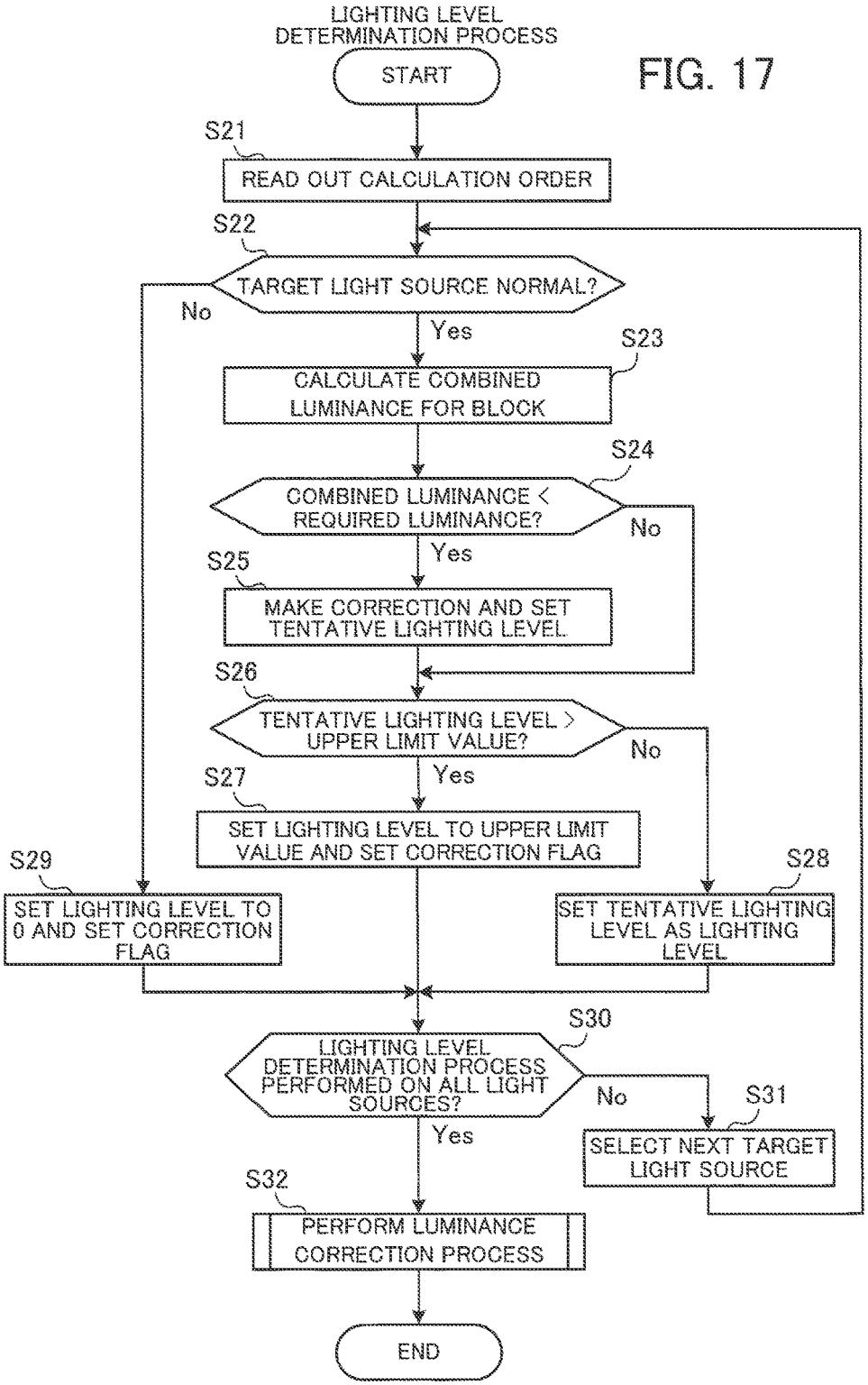
FIG. 17 is a flow chart of a procedure for a lighting level determination process in the third embodiment.

FIG. 17 is a flow chart of a procedure for a lighting level determination process in the third embodiment.

(Step S21) The lighting level determination unit 28 reads out calculation order stored in calculation order storage 271 and selects a target light source BLn from among a plurality of light sources on the basis of the calculation order which the lighting level determination unit 28 reads out.

(Step S22) The lighting level determination unit 28 determines on the basis of failure information acquired from the light source drive section 60*a* whether or not the target light source BLn is normal. If the lighting level determination unit 28 determines that the target light source BLn is normal, then the lighting level determination unit 28 proceeds to step S23. If the lighting level determination unit 28 determines that the target light source BLn has failed, then the lighting level determination unit 28 proceeds to step S29.

(Step S23) The lighting level determination unit 28 calculates combined luminance for a block corresponding to the selected light source BLn on the basis of a tentative lighting level of the selected light source BLn, a tentative lighting level or a determined lighting level of another light source, and light-source-specific LUTs.

(Step S24) The lighting level determination unit 28 compares the calculated combined luminance and required luminance for the block corresponding to the selected light source BLn to determine whether or not the calculated combined luminance is lower than the required luminance. If the calculated combined luminance satisfies the required luminance, then the lighting level determination unit 28 proceeds to step S26. If the calculated combined luminance is lower than the required luminance, then the lighting level determination unit 28 proceeds to step S25.

(Step S25) The lighting level determination unit 28 makes a correction according to the difference between the required luminance and the combined luminance and sets a tentative lighting level of the light source BLn which satisfies the required luminance.

(Step S26) The lighting level determination unit 28 determines whether or not the tentative lighting level of the light source BLn is higher than the upper limit value of a lighting level. If the tentative lighting level of the light source BLn is higher than the upper limit value of a lighting level, then the lighting level determination unit 28 proceeds to step S27. If the tentative lighting level of the light source BLn is not higher than the upper limit value of a lighting level, then the lighting level determination unit 28 proceeds to step S28.

(Step S27) The lighting level determination unit 28 sets a lighting level of the light source BLn to the upper limit value, sets a correction flag, and proceeds to step S30.

(Step S28) The lighting level determination unit 28 sets the tentative lighting level of the light source BLn as a lighting level of the light source BLn.

(Step S29) The lighting level determination unit 28 sets a lighting level of the failed light source BLn to 0 and sets a correction flag.

(Step S30) The lighting level determination unit 28 determines whether or not the lighting level determination process has been performed on all the light sources. If the lighting level determination unit 28 determines that lighting levels of all the light sources have been determined, then the lighting level determination unit 28 proceeds to step S32. If the lighting level determination unit 28 determines that lighting levels of all the light sources have not been determined, then the lighting level determination unit 28 proceeds to step S31.

(Step S31) The lighting level determination unit 28 selects the next target light source on the basis of the calculation order stored in the calculation order storage 271, and proceeds to step S22.

(Step S32) The lighting level determination unit 28 performs a luminance correction process and then ends the lighting level determination process.

Figure 18:
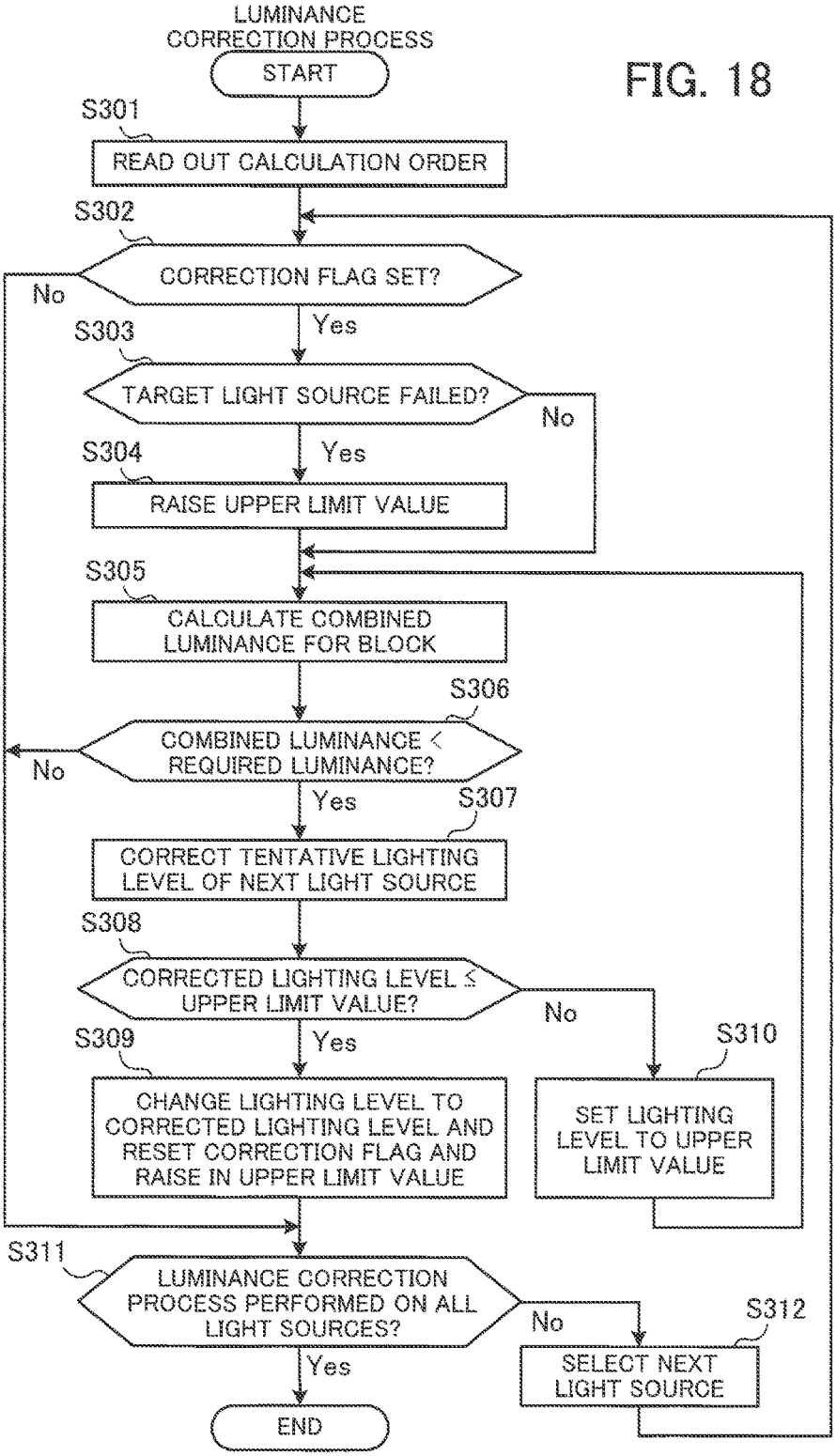
FIG. 18 is a flow chart of a procedure for a luminance correction process in the third embodiment.

FIG. 18 is a flow chart of a procedure for the luminance correction process in the third embodiment.

(Step S301) The lighting level determination unit 28 reads out the calculation order stored in the calculation order storage 271 and selects a target light source BLn from among the plurality of light sources on the basis of the calculation order which the lighting level determination unit 28 reads out.

(Step S302) The lighting level determination unit 28 determines whether or not a correction flag is set on the target light source BLn. If a correction flag is set on the target light source BLn, then the lighting level determination unit 28 proceeds to step S303. If a correction flag is not set on the target light source BLn, then the lighting level determination unit 28 proceeds to step S311.

(Step S303) The lighting level determination unit 28 determines whether or not the target light source BLn has failed. If the lighting level determination unit 28 determines that the target light source BLn has failed, then the lighting level determination unit 28 proceeds to step S304. If the lighting level determination unit 28 does not determine that the target light source BLn has failed, then the lighting level determination unit 28 proceeds to step S305.

(Step S304) If the target light source BLn has failed, then the lighting level determination unit 28 raises the upper limit value of a lighting level.

(Step S305) The lighting level determination unit 28 calculates combined luminance for a block corresponding to the selected light source BLn.

(Step S306) The lighting level determination unit 28 compares the calculated combined luminance and required luminance for the block corresponding to the selected light source BLn to determine whether or not the calculated combined luminance is lower than the required luminance. If the calculated combined luminance satisfies the required luminance, then the lighting level determination unit 28 proceeds to step S311. If the calculated combined luminance is lower than the required luminance, then the lighting level determination unit 28 proceeds to step S307.

(Step S307) The lighting level determination unit 28 calculates a lighting level of a next light source whose turn comes next in the calculation order by which a deficiency in luminance corresponding to the difference between the combined luminance and the required luminance for the block corresponding to the selected light source BLn is made up for. By doing so, the lighting level determination unit 28 corrects a tentative lighting level of the next light source. A tentative lighting level of a next light source is corrected in order in this way in accordance with the calculation order. For example, if the deficiency in luminance is not made up for by the light source BL(n+1) whose turn comes next to the selected light source BLn in the calculation order, then the deficiency in luminance is made up for by the light source BL(n+2) whose turn comes next to the light source BL(n+1) in the calculation order. On the basis of a light-source-specific LUT for the next light source, the lighting level determination unit 28 calculates a corrected lighting level by which the difference between the combined luminance and the required luminance for the block corresponding to the selected light source BLn is made up for.

(Step S308) The lighting level determination unit 28 compares the corrected lighting level and the upper limit value to determine whether or not the corrected lighting level is higher than the upper limit value. If the corrected lighting level is not higher than the upper limit value, then the lighting level determination unit 28 proceeds to step S309. If the corrected lighting level is higher than the upper limit value, then the lighting level determination unit 28 proceeds to step S310.

(Step S309) The lighting level determination unit 28 changes a lighting level to the corrected lighting level, resets the correction flag and the raise in the upper limit value, and proceeds to step S311.

(Step S310) The lighting level determination unit 28 sets a lighting level to the upper limit value and proceeds to step S305.

(Step S311) The lighting level determination unit 28 determines whether or not the luminance correction process has been performed on all light sources. If there remains a light source on which a correction flag is set after the round of the calculation order, then the lighting level determination unit 28 considers that the luminance correction process has not been performed on all the light sources, and reverses the calculation order. If the lighting level determination unit 28 determines that lighting levels of all the light sources have been corrected, then the lighting level determination unit 26 ends the luminance correction process. If the lighting level determination unit 28 determines that lighting levels of all the light sources have not been corrected, then the lighting level determination unit 28 proceeds to step S312.

(Step S312) The lighting level determination unit 28 selects the next target light source on the basis of the calculation order stored in the calculation order storage 271, and proceeds to step S302.

The lighting level determination process in the third embodiment is performed through the above procedures. In the third embodiment, a lighting level of a failed light source is considered to be zero. As a result, there arises a deficiency in luminance. This deficiency in luminance is made up for by another normal light source. Accordingly, a deficiency in luminance caused by a failure in a light source is reduced.

In the display device according to the third embodiment, the light sources BLn are arranged along one side of a light guide plate 54. However, another arrangement of light sources may be adopted. With the arrangement of the light sources illustrated in FIG. 12, for example, it is assumed that a failed light source is detected and that there is a deficiency in luminance. This deficiency in luminance is made up for by light sources adjacent to the failed light source and light sources arranged along an opposite side.

The above processing functions can be realized with a computer. In that case, a program in which the contents of the functions that the display device has are described is provided. By executing this program on the computer, the above processing functions are realized on the computer. This program may be recorded on a computer readable record medium. A computer readable record medium may be a magnetic storage device, an optical disk, a magneto-optical recording medium, a semiconductor memory, or the like. A magnetic storage device may be a hard disk drive (HDD), a flexible disk (FD), a magnetic tape, or the like. An optical disk may be a digital versatile disc (DVD), a DVD-random access memory (RAM), a compact disc read only memory (CD-ROM), a CD-recordable (R)/rewritable (RW), or the like. A magneto-optical recording medium may be a magneto-optical disk (MO) or the like.

To place the program on the market, portable record media, such as DVDs or CD-ROMs, on which it is recorded are sold. Alternatively, the program is stored in advance in a storage unit of a server computer and is transferred from the server computer to another computer via a network.

When a computer executes this program, it will store the program, which is recorded on a portable record medium or which is transferred from the server computer, in, for example, its storage unit. Then the computer reads the program from its storage unit and performs processes in compliance with the program. The computer may read the program directly from a portable record medium and perform processes in compliance with the program. Furthermore, each time the program is transferred from the server computer connected via a network, the computer may perform processes in order in compliance with the program it receives.

In addition, at least a part of the above processing functions may be realized by an electronic circuit such as a digital signal processor (DSP), an application specific integrated circuit (ASIC), or a programmable logic device (PLD).

Various changes and modifications which fall within the scope of the concept of the present disclosure are conceivable by those skilled in the art and it is understood that these changes and modifications fall within the scope of the present disclosure. For example, those skilled in the art may add components to, delete components from, or make changes in the design of components in each of the above embodiments according to circumstances, or may add processes to, omit processes from, or make changes in conditions in processes in each of the above embodiments according to circumstances. These additions, deletions, changes, and omissions fall within the scope of the present disclosure as long as they include the essentials of the present disclosure.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that various changes, substitutions, and alterations could be made hereto without departing from the spirit and scope of the invention.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A display device comprising:

an image display panel;

a backlight in which a plurality of light sources driven independently of one another are arranged and which lights the image display panel;

a backlight controller configured to calculate, on the basis of required luminance for each divided area based on an image signal and luminance distribution information for the backlight stored in advance, a tentative lighting level of each of the plurality of light sources corresponding to the required luminance, select the plurality of light sources in order in accordance with determined calculation order, calculate estimated luminance of a selected light source on the basis of the tentative lighting levels of the plurality of light sources or a calculated lighting level of a light source whose turn comes earlier in the calculation order and the luminance distribution information, and calculate, when the estimated luminance does not satisfy the required luminance, a lighting level of the selected light source that satisfies the required luminance on the basis of a tentative lighting level of the selected light source and the luminance distribution information; and a calculation order change section configured to change the calculation order at determined timing, wherein the calculation order change section includes:

storage configured to store a plurality of calculation order patterns that differ in calculation order in which lighting levels of the plurality of light sources are calculated; and a calculation order switcher configured to detect that a determined switching condition has come into existence and to switch a calculation order pattern used by the backlight controller to another calculation order pattern stored in the storage.

2. The display device according to claim 1, wherein the backlight controller is configured to:

set, when the calculated lighting level of the selected light source exceeds a determined upper limit value, a lighting level of the selected light source to an upper-limit lighting level; and make up for a difference between estimated luminance obtained by lighting the selected light source at the upper-limit lighting level and the required luminance by lighting levels of subsequent light sources in the calculation order.

3. The display device according to claim 1, wherein the calculation order change section is configured to:

store the determined switching condition in advance in the storage;

detect an operating state of the display device;

compare the detected operating state and the determined switching condition; and switch, when the detected operating state matches the determined switching condition, the calculation order pattern used by the backlight control section.

4. The display device according to claim 3, wherein the determined switching condition is timing at which the image display panel switches from on to off or timing at which the image display panel switches from off to on.

* * * * *